US011059090B1

(12) United States Patent
Head et al.

(10) Patent No.: US 11,059,090 B1
(45) **Date of Patent: *Jul. 13, 2021**

(54) SERVO-DRIVEN SEAMER ASSEMBLY FOR SEALING A CONTAINER

(71) Applicant: Norland International, Inc., Lincoln, NE (US)

(72) Inventors: Michael Head, Lincoln, NE (US); Allan Provorse, Lincoln, NE (US); Tyler Spellman, Lincoln, NE (US)

(73) Assignee: Norland International, Inc., Lincoln, NE (US)

( * ) Notice: Subject to any disclaimer, the term of this patent is extended or adjusted under 35 U.S.C. 154(b) by 164 days.

This patent is subject to a terminal disclaimer.

(21) Appl. No.: 16/267,157

(22) Filed: Feb. 4, 2019

Related U.S. Application Data

(63) Continuation of application No. 15/586,130, filed on May 3, 2017, now Pat. No. 10,195,657.
(Continued)

(51) Int. Cl.
*B21D 51/32* (2006.01)
*B21D 51/26* (2006.01)
(Continued)

(52) U.S. Cl.
CPC ..... *B21D 51/32* (2013.01); *B21D 51/2661* (2013.01); *B65B 7/285* (2013.01); *B65B 59/00* (2013.01); *B21D 51/2653* (2013.01)

(58) Field of Classification Search
CPC ..... B21D 51/26; B21D 51/2615; B21D 51/2623; B21D 51/2653; B21D 51/2661; B21D 51/30; B21D 51/32; B65B 7/285
See application file for complete search history.

(56) References Cited

U.S. PATENT DOCUMENTS 2,680,419 A 6/1954 Peterson, Jr. et al.
4,004,529 A 1/1977 Grotnes
(Continued)

FOREIGN PATENT DOCUMENTS

DE 43 13 451 A1 10/1994
DE 10217933 A1 11/2003
(Continued)

OTHER PUBLICATIONS

Translation, Shimura et al. JP 2001-259766 A, Sep. 25, 2001.*
(Continued)

*Primary Examiner* — Edward T Tolan
(74) *Attorney, Agent, or Firm* — Foley & Lardner LLP

(57) ABSTRACT

A seamer assembly includes a frame, a first servo assembly, a second servo assembly, a first support element, a second support element, a first die, and a second die. The first servo assembly is coupled to the frame. The first servo assembly includes a chuck that is configured to be rotated by the first servo assembly. The second servo assembly is coupled to the frame. The first support element is configured to support a can subassembly that includes a can body and a lid relative to the frame where at least one of the first support element, the first servo assembly and second servo assembly move relative to the other of the first support element, the first servo assembly and second servo assembly. The second support element is coupled to the second servo assembly. The first die is coupled to the second support element. The second die is coupled to the second support element. The first support element is configured to support a can subassembly such that the chuck is received in a first chuck position. The first servo assembly is configured to selectively rotate the can subassembly when the chuck is received in the first chuck position. The second servo assembly is configured to selectively reposition the second support ele-
(Continued)

ment such that the first die and the second die are correspondingly repositioned.

15 Claims, 22 Drawing Sheets

Related U.S. Application Data

(60) Provisional application No. 62/331,227, filed on May 3, 2016.

(51) Int. Cl.
*B65B 7/28* (2006.01)
*B65B 59/00* (2006.01)

(56) References Cited

U.S. PATENT DOCUMENTS

| | | | | |
|---|---|---|---|---|
| 4,218,983 | A | 8/1980 | Rhinefrank et al. | |
| 5,074,034 | A | 12/1991 | Lebbon | |
| 5,782,599 | A | 7/1998 | Moran et al. | |
| 5,860,782 | A | 1/1999 | Campbell | |
| 5,911,552 | A | 6/1999 | Shimizu et al. | |
| 6,623,230 | B1 | 9/2003 | Bagheri et al. | |
| 6,857,250 | B1 | 2/2005 | Taylor | |
| 6,890,140 | B2 | 5/2005 | Egerton et al. | |
| 10,195,657 | B1 * | 2/2019 | Head | B21D 51/2661 |
| 2010/0064751 | A1 | 3/2010 | Anthenat et al. | |
| 2010/0196123 | A1 * | 8/2010 | Oohori | B21D 51/2653 413/31 |
| 2010/0218457 | A1 | 9/2010 | Tonti et al. | |
| 2013/0108399 | A1 | 5/2013 | Aldred et al. | |
| 2014/0069062 | A1 | 3/2014 | Bogle et al. | |
| 2018/0065168 | A1 * | 3/2018 | Obata | B21D 39/02 |

FOREIGN PATENT DOCUMENTS

| | | | | |
|---|---|---|---|---|
| EP | 0 322 843 | A1 | 7/1989 | |
| EP | 1 230 999 | A1 | 8/2002 | |
| EP | 2 197 605 | A2 | 6/2010 | |
| JP | 2001-259766 | A * | 9/2001 | B21D 51/18 |
| WO | WO-93/15957 | A1 | 8/1993 | |

OTHER PUBLICATIONS

"MACS: Micro-Automated Canning System," Cask Brewing System, Inc., 5 pages, retrieved from http://www.cask.com/canning-systems/macs-micro-automated-canning-system/ on Sep. 12, 2017.

* cited by examiner

SERVO-DRIVEN SEAMER ASSEMBLY FOR SEALING A CONTAINER

CROSS-REFERENCE TO RELATED PATENT APPLICATIONS

The present application is a Continuation of U.S. patent application Ser. No. 15/586,130, filed May 3, 2017, which claims the benefit of priority to U.S. Provisional Patent Application No. 62/331,227, filed May 3, 2016, the entire disclosures of which are incorporated herein by reference in their entireties.

TECHNICAL FIELD

Embodiments of the present disclosure relate to a servo-driven seamer assembly for sealing a container containing goods, for example, food and beverages.

BACKGROUND

A container such as a can is often used in the packaging of food and beverages (and other goods), and the can is often filled with contents intended to be sealed from the environment. For example, beer, soda, paint, coffee, tea, wine, liquor, soup, sardines, and other goods may be contained within a container such as a can. These containers may hold various volumes (e.g., twelve fluid ounces, ten fluid ounces, etc.).

In a processing operation, the can is typically first filled with the contents and then sealed, thereby sealing the contents from the outside environment. Traditionally, cans are sealed (e.g., seamed, etc.) via a seaming operation whereby a machine forms a double fold, known as a double-seam (e.g., seam, etc.), between a can and a closure or lid. The seaming operation is a process of mechanically attaching the can and the closure or lid together to create a substantially air-tight seal. Typically, a double-seam is formed on the can as a result of the seaming operation.

The sealing of the can from the environment may be compromised if the seaming operation is not performed properly. When the sealing is compromised, the contents of the can may be unsuitable for consumption or use. Accordingly, ensuring the sealing operation is performed properly is of paramount importance in the packaging of goods, including food and beverages. Specifically, flanges on the can and the lid are folded onto one-another to seal out the environment Conventional seaming devices operate either by spinning a can continuously within tooling (e.g., dies, etc.) or by spinning tooling (e.g., dies, etc.) around a can. Typically, conventional seaming devices utilize cams and/or pneumatic air cylinders to cause rotation, either directly or indirectly, through the use of gears, cams, linkages, and other similar mechanical structures. Further, conventional seaming devices do not provide a mechanism for continuously and accurately monitoring position and/or speed of the tooling. Conventional seaming devices require specialized professional and/or expensive equipment to measure and monitor the quality of the seam for double-seam cans.

SUMMARY

One embodiment relates to a seamer assembly. The seamer assembly includes a frame, a first servo assembly, a second servo assembly, a first support element, a second support element, a first die, and a second die. The first servo assembly is coupled to the frame. The first servo assembly includes a chuck that is configured to be rotated by the first servo assembly. The second servo assembly is coupled to the frame. The first support element is configured to support a can subassembly that includes a can body and a lid relative to the frame where at least one of the first support element, the first servo assembly and second servo assembly move relative to the other of the first support element, the first servo assembly and second servo assembly. The second support element is coupled to the second servo assembly. The first die is coupled to the second support element. The second die is coupled to the second support element. The first support element is configured to support a can subassembly such that the chuck is received in a first chuck position. The first servo assembly is configured to selectively rotate the can subassembly when the chuck is received in the first chuck position. The second servo assembly is configured to selectively reposition the second support element such that the first die and the second die are correspondingly repositioned.

Another embodiment relates to a seamer assembly. The seamer assembly includes a frame, a first servo assembly, and a chuck. The first servo assembly is coupled to the frame. The first servo assembly is configured to selectively provide a first rotational force. The chuck is coupled to the first servo assembly. The chuck is selectively received in a first chuck position relative to a can subassembly. The can subassembly is coupled to the chuck in the first chuck position. The chuck is configured to receive the first rotational force from the first servo assembly and to provide the first rotational force to the can subassembly when the chuck is in the first chuck position.

Yet another embodiment relates to a seamer assembly. The seamer assembly includes a frame, a first servo assembly, a second servo assembly, a chuck, a servo arm, a first die, a second die, and a processing circuit. The frame includes an upper panel and a lower panel. The first servo assembly is coupled to the upper panel. The first servo assembly is configured to selectively provide a first rotational force. The second servo assembly is coupled to the upper panel. The second servo assembly is configured to selectively provide a second rotational force. The chuck is coupled to the first servo assembly. The chuck is selectively received in a first chuck position relative to a can subassembly thereby causing a can subassembly to be coupled to the chuck. The chuck is configured to receive the first rotational force from the first servo assembly and to provide the first rotational force to a can subassembly when the chuck is in the first chuck position. The servo arm is coupled to the second servo assembly. The servo arm is configured to receive the second rotational force. The first die is coupled to the servo arm. The second die is coupled to the servo arm. The processing circuit is configured to control the second rotational force such that one of the first die and the second die selectively contacts a can subassembly for a first period of time and such that the other of the first die and the second die selectively contacts a can subassembly for a second period of time thereby forming a can assembly.

These and other features, together with the organization and manner of operation thereof, may become apparent from the following detailed description when taken in conjunction with the accompanying drawings.

DETAILED DESCRIPTION

Figure 1:
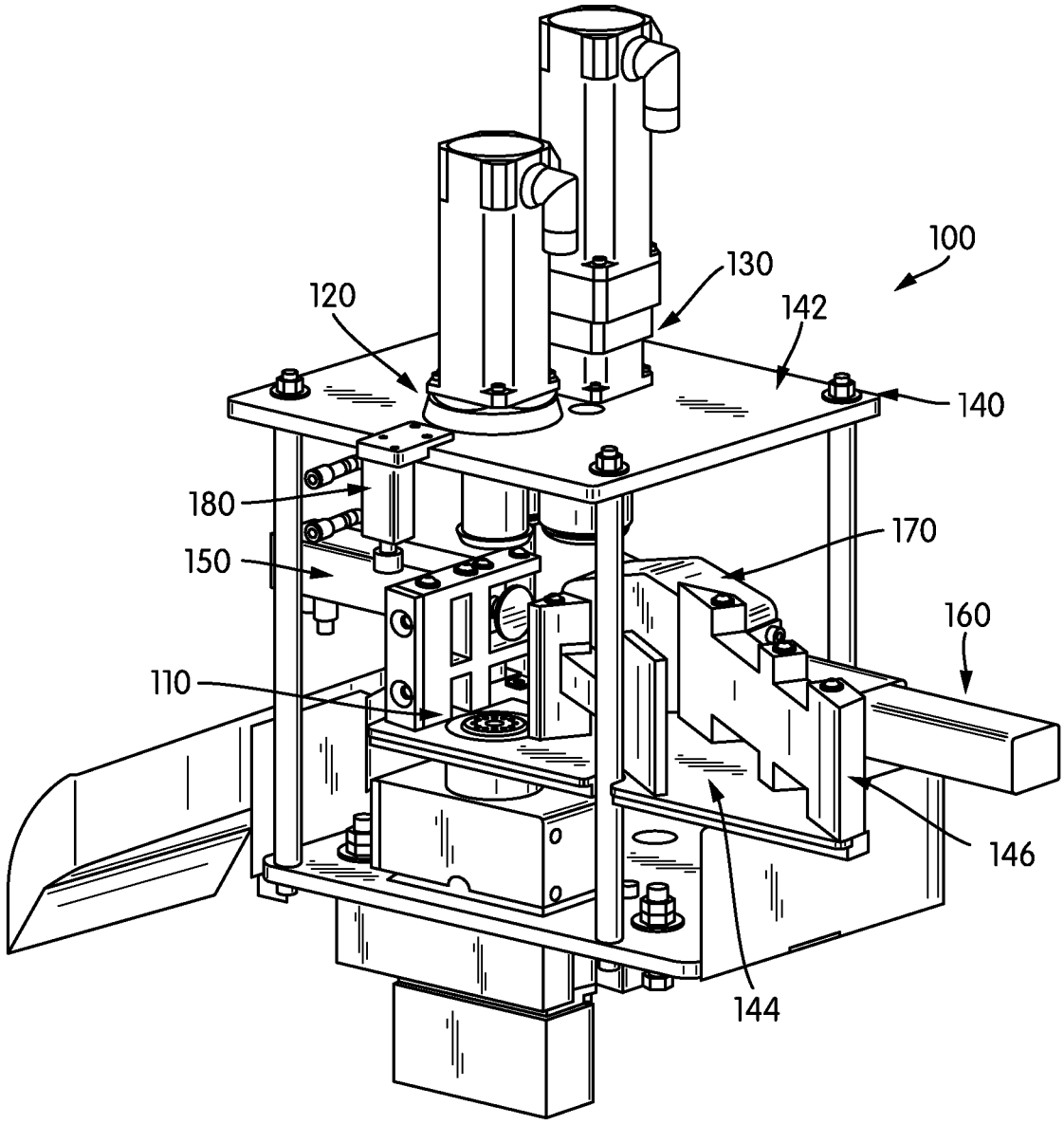
FIG. 1 is a perspective view of a seamer assembly, according to an exemplary embodiment.
Figure 2:
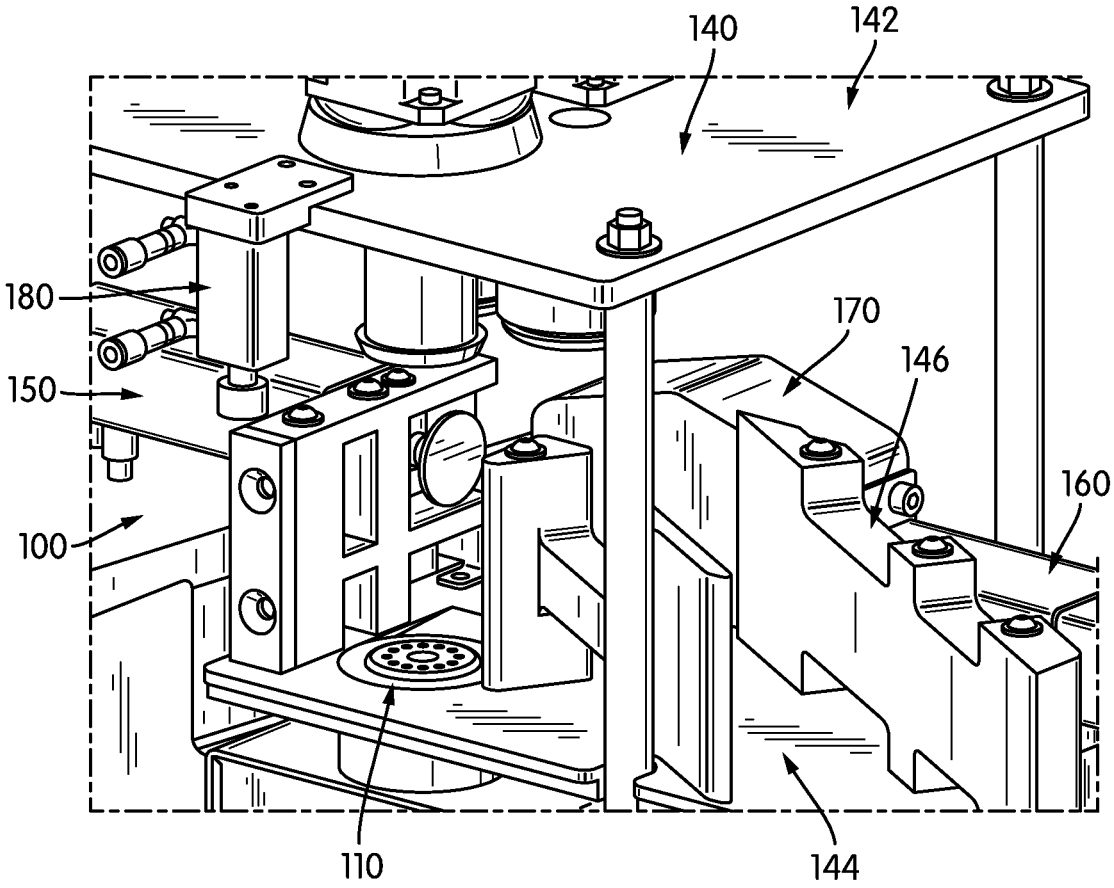
FIG. 2 is a detailed view of the seamer assembly shown in FIG. 1.
Figure 3:
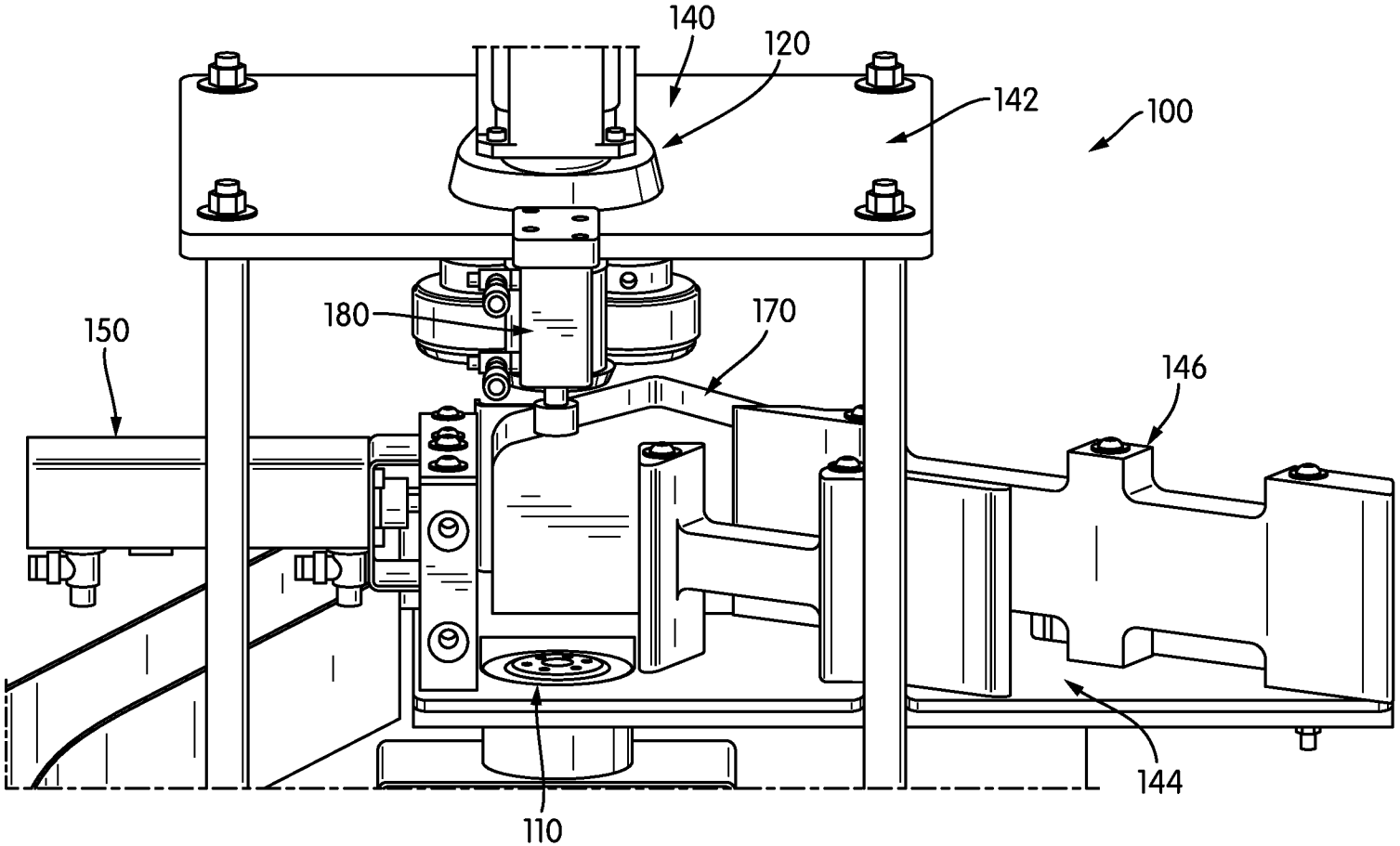
FIG. 3 is a front view of the seamer assembly shown in FIG. 1.

Referring to the Figures generally, systems, methods, and apparatuses for a servo-driven seamer assembly for sealing containers, and in particular, containers for food and beverage items are depicted and described herein.

Referring to FIGS. 1-4 and 12-19, a seamer assembly 100 that facilitates reliable, repeatable formation of double-seams on containers such as cans is shown.

A broad overview of one embodiment of the invention is as follows. The seamer assembly 100 receives an open can 400 which has been filed with whatever contents are to be sealed therein and a lid 410 configured to cooperate with the open can 400 to create a seal between the lid 410 and the open can 400, preferably a double-seam. The open can 400 is received on a support element, preferably a rotating platform 110. The rotating platform 110 supports and elevates the can subassembly 415 to bring the can subassembly 415 into contact with the chuck servo assembly 120. The chuck servo assembly 120 may then rotate the open can 400 and lid 410. The chuck servo assembly 120 measures a number of rotations of the can subassembly 415. A die servo assembly 130 may then bring a first die 730 and a second die 740 into contact with the open can 400 and the lid 410, each for a target number of rotations of the can subassembly 415. The first die 730 and the second die 740 cooperate with one another to seal the lid 410 to the open can 400 by a double-seam, thereby forming a can assembly 420. Once the can assembly 420 is formed, as determined by the chuck servo assembly 120 having rotated the can subassembly 415 a target number of rotations, the rotating platform 110 lowers the can assembly 420 to a point in which it is adjacent to an advancing actuator 150. The advancing actuator 150 then advances the can assembly 420 down an assembly line for further processing.

The seamer assembly 100 is capable of determining if a can assembly 420 has been improperly sealed. When the seamer assembly 100 determines that a can assembly 420 is improperly sealed, the gate actuator 160 biases a gate 170 such that the improperly sealed can assembly is diverted to a location separate and distinct from the assembly line for which the properly sealed can assemblies traverse. For example, the seamer assembly 100 may utilize the gate actuator 160 and the gate 170 to divert improperly sealed can assemblies onto an area for inspection.

As shown in FIG. 1, the frame 140 comprises an upper panel 142 a spaced distance from a lower panel 144, and a guide structure 146 positioned therebetween. The guide structure 146 is preferably disposed on and/or coupled to the lower panel 144. According to various embodiments, the chuck servo assembly 120 and the die servo assembly 130 are coupled to the upper panel 142. In these embodiments, the rotating platform 110 protrudes through an opening in the lower panel 144 such that the rotating platform 110 and the lower panel 144 are substantially coplanar. Similarly, the lower panel 144 supports the open cans 400 and the can assemblies 420. Preferably, the guide structure 146 is coupled to the lower panel 144 such that can assemblies 420 can be directed out of the seamer assembly 100.

The lower panel 144 is adapted to support cans, lids, and can assemblies as they move into and out of the seamer assembly 100. In operation, can assemblies slide along the lower panel 144 and onto the rotating platform 110 where the can assemblies are seamed through the cooperation and interaction of the chuck servo assembly 120 and the die servo assembly 130. After being seamed, the can assemblies slide off of the rotating platform 110 onto the lower panel 144 by the advancing actuator 150.

Figure 4:
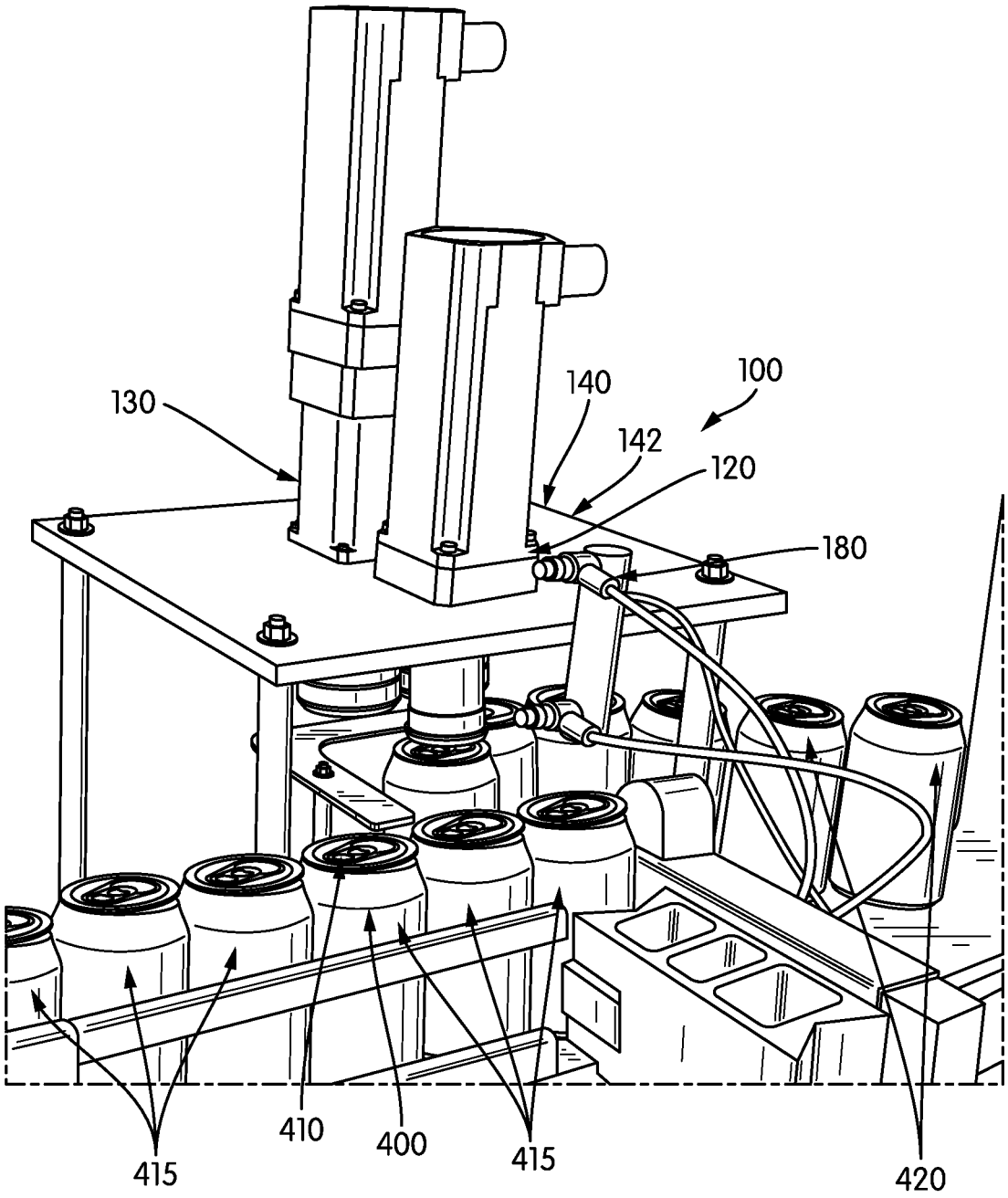
FIG. 4 is a perspective view of the seamer assembly shown in FIG. 1 installed in an assembly line, according to an exemplary embodiment.

The seamer assembly 100 is adapted to receive open cans containing beverages (e.g., beer, soda, liquor, etc.), food (e.g., powdered milk, fruits, vegetables, etc.), or other goods and seal them. The seamer assembly 100 receives an open can 400 (e.g., a can that has not been sealed) and a lid 410 (e.g., a closure, etc.) that is placed on top of the open can 400, as shown in FIG. 4, thereby forming a can subassembly 415 (e.g., an unsealed can, etc.). The seamer assembly 100 seals the open can 400 and the lid 410 with a double-seam thereby forming a can assembly 420. In these embodiments, the lid 410 is placed on top of an opening (e.g., a central opening, an aperture, etc.) in the open can 400. In some applications, the chuck servo assembly 120 and/or the die servo assembly 130 are coupled to the lower panel 144 rather than the upper panel 142.

The seamer assembly 100 is also shown to include a lid tamp 180 that is coupled to the upper panel 142. The lid tamp 180 is provided to bias the lid 410 on the open can 400 as part of the creation of the can subassembly 415. The lid tamp 180 utilizes a ram (e.g., rod, arm, etc.) to bias the lid 410 on the open can 400. In other applications, however, the lid tamp 180 may be incorporated at a different point of an assembly line, for example earlier in the process, than the seamer assembly 100 belongs.

Figure 5:
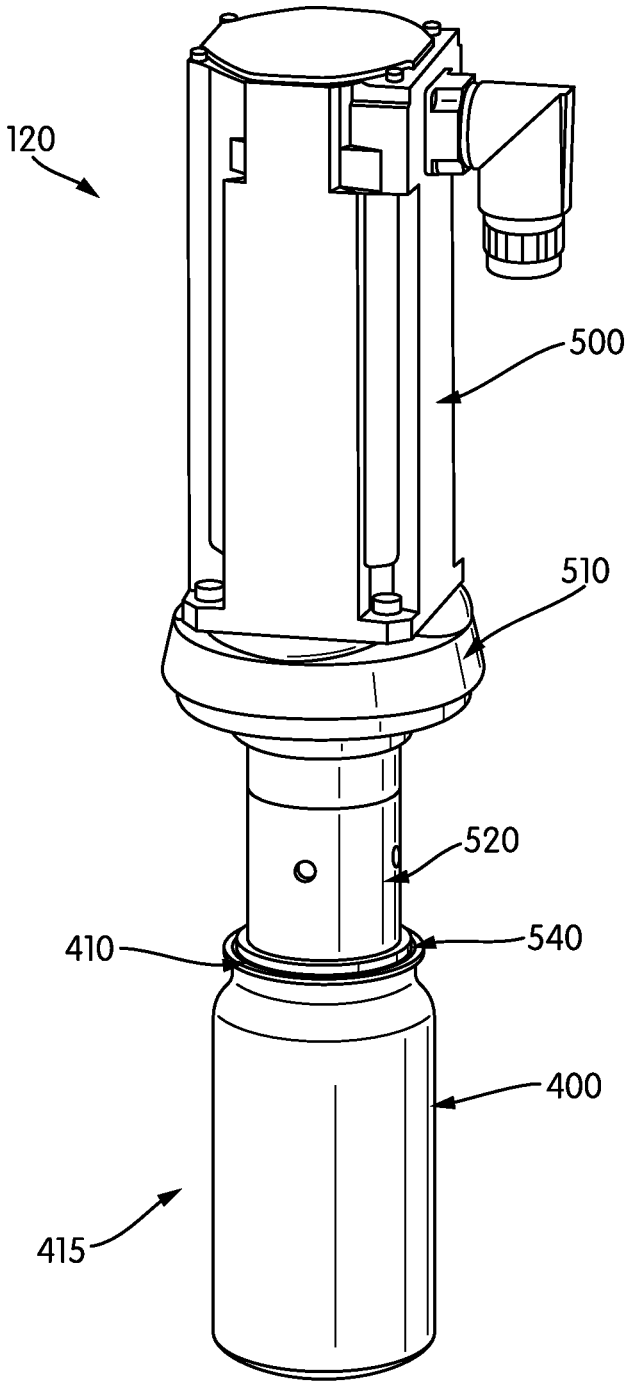
FIG. 5 is a perspective view of a can and lid assembly coupled to a chuck servo assembly for use in the seamer assembly shown in FIG. 1, according to an exemplary embodiment.

As shown in FIG. 5, the chuck servo assembly 120 comprises a chuck servo 500, a chuck bearing assembly 510 coupled to the chuck servo 500, and a chuck 520 coupled to the chuck bearing assembly 510. The chuck 520 couples the chuck servo assembly 120 to the can subassembly 415 and/or the can assembly 420. For example, the chuck 520 is preferably configured to transfer rotational energy from the chuck servo 500 to the open can 400 and the lid 410. The chuck servo 500 rotates the chuck 520 through the interconnection provided by the chuck bearing assembly 510. The chuck servo 500 is electronically controlled and is configured to send position and/or electrical data (e.g., current) to a processing circuit for analysis. The chuck bearing assembly 510 include a plurality of bearings (e.g., ball bearings, etc.) that reduce friction and/or load on the chuck servo 500 and/or the chuck 520.

Figure 6:
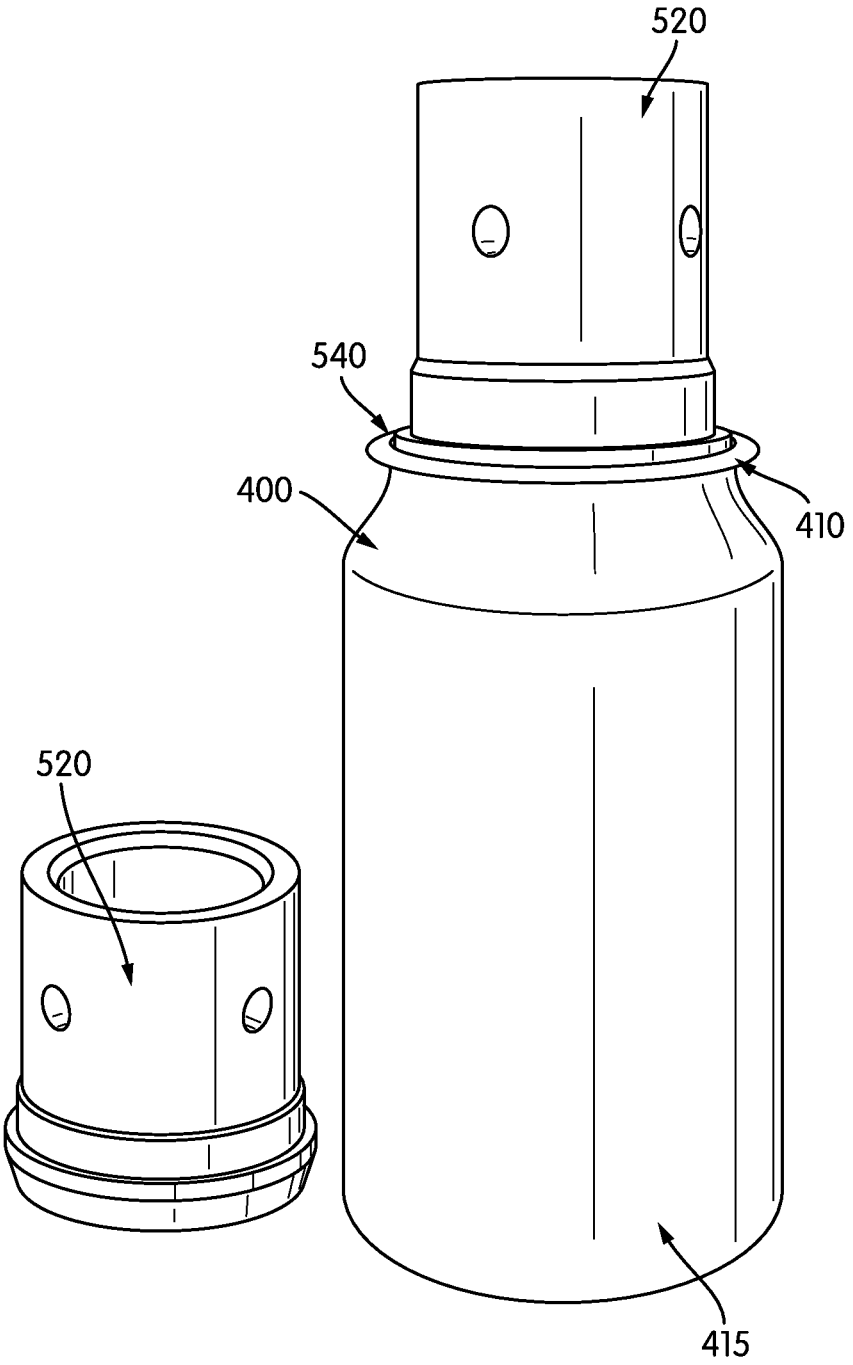
FIG. 6 is a view of a chuck for use in the chuck servo assembly shown in FIG. 5, and a can and lid assembly coupled to the chuck, according to an exemplary embodiment.

The chuck 520 is formed to (e.g., configured to, able to, sized to, etc.) be received within the open can 400, as shown in FIG. 6. Specifically, the chuck 520 is sized to be received within a chuck position, preferably a depression 540 (e.g., aperture, central opening, etc.). The size of the depression 540 depends on the open can 400 and/or the lid 410. Thus, the size and configuration of the chuck 520 can be varied depending on the open can 400 and/or the lid 410. While the can subassembly 415 is received within the chuck 520, a first die 730 or a second die 740, as shown in FIG. 7, contact the open can 400 and the lid 410, thereby sealing the lid 410 to the open can 400 with a double-seam and forming the can assembly 420.

Figure 7:
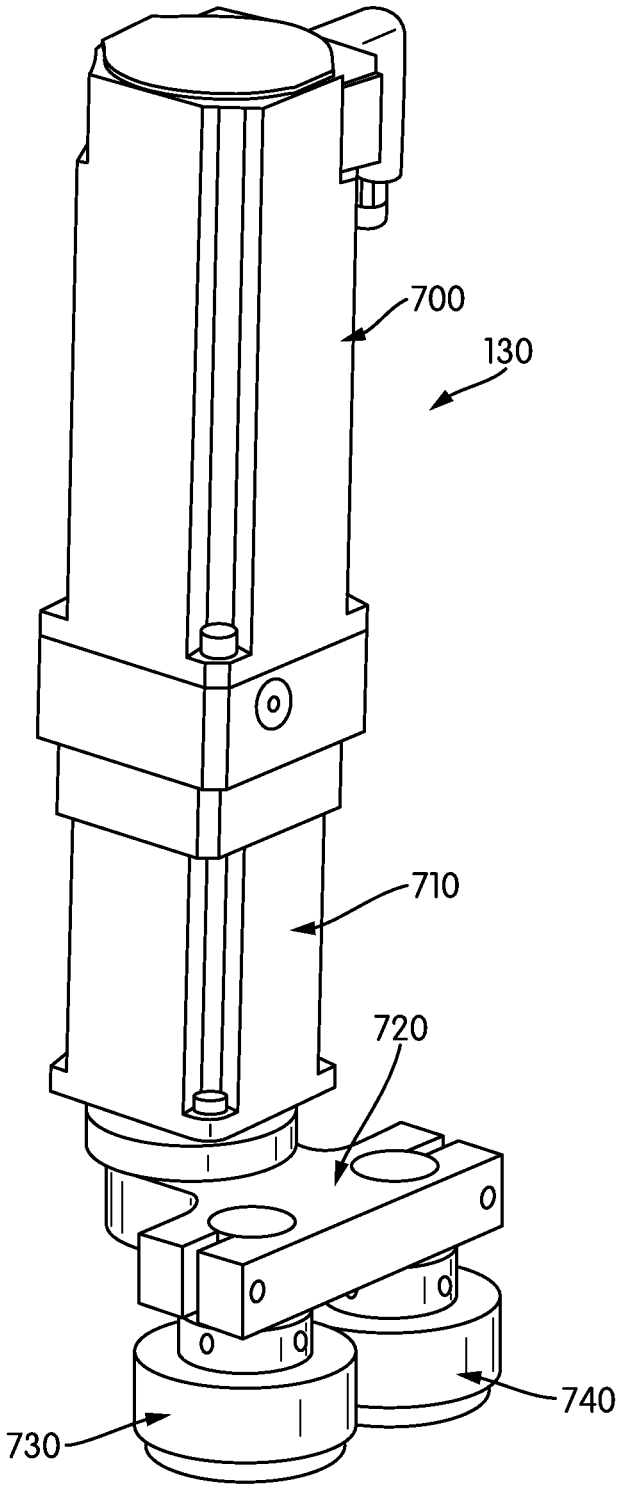
FIG. 7 is a perspective view of a die servo assembly for use in the seamer assembly shown in FIG. 1, according to an exemplary embodiment.

As shown in FIG. 7, the die servo assembly 130 includes a die servo 700, a die servo gearbox 710 coupled to the die servo 700, a support element, preferably a seamer arm 720 coupled to the die servo gearbox 710, a first die 730 (e.g., a tooling die, etc.) coupled to the die seamer arm 720, and a second die 740 (e.g., a tooling die, etc.) coupled to the die seamer arm 720. The die servo 700 manipulates a position of the first die 730 and/or the second die 740 through rotation of a shaft of the die servo 700.

In operation, the chuck 520 is received within the lid 410 and rotated by the chuck servo 500, thereby causing rotation of the can subassembly 415. As the can subassembly 415 is rotated by the chuck 520, the die servo 700 causes the seamer arm 720 to rotate such that one of the first die 730 and the second die 740 is brought into contact with the can subassembly 415. The contact between one of the first die 730 and the second die 740 and the can subassembly 415 partially seams the lid 410 to the open can 400. The contact between the other of the first die 730 and the second die 740 and the can subassembly 415 completely seams the lid 410 to the open can 400, thereby forming the can assembly 420. Then, the die servo 700 rotates the seamer arm 720 so as to remove the first die 730 and the second die 740 from contact with the can assembly 420.

The seamer assembly 100 determines that the can subassembly 415 has been seamed based on feedback criteria from a multitude of sources on the machine (e.g., electrical sensors, internal parameters of each servo assembly, etc.). In an exemplary embodiment, die servo assembly 130 may be commanded to rotate the die seamer arm 720 once a sensor has indicated a can subassembly 415 has been fitted onto the chuck 520. The die servo assembly 130 then rotates the die seamer arm 720 to bring the first die 730 into contact with the can subassembly 415 for a first target number of rotations once the chuck servo assembly 120 has determined that the can subassembly 415 is rotating at a target rotational speed. The die servo assembly 130 then rotates the die seamer arm 720 to remove the first die 730 from contact with the can subassembly 415 and to bring the second die 740 into contact with the can subassembly 415 for a second target number of rotations once the chuck servo assembly 120 has determined that the first die 730 has contacted the can subassembly 415 for the first target number of rotations. The die servo assembly 130 then rotates the die seamer arm 720 to remove the second die 740 from contact with the can subassembly 415 once the chuck servo assembly 120 has determined that the second die 740 has contacted the can subassembly 415 for the second target number of rotations. The seamer assembly 100 may then wait a period of time, as determined by a timer, and then cease to rotate the can assembly 420 and lower the rotating platform 110 to decouple the can assembly 420 from the chuck 520.

The die servo gearbox 710 modifies (e.g., increase, decrease, etc.) torque and/or speed associated with the rotation of the shaft of the die servo 700. Specifically, the die servo gearbox 710 implements a gear reduction on the die servo 700. The die seamer arm 720 provides a single structure (e.g., component, etc.) through which the first die 730 and the second die 740 are coupled to the die servo 700 and transfers energy from the die servo gearbox 710 to the first die 730 and the second die 740.

According to various embodiments, the chuck servo 500 and the die servo 700 provide discrete position and speed control to seamer assembly 100. Accordingly, the seamer assembly 100 is capable of controlling the chuck servo 500 and/or the die servo 700 to a high degree of precision resulting in increased reliability and repeatability of seamer assembly 100 in producing can assemblies with a desirable double-seam, such as is present in the can assembly 420.

The die servo gearbox 710 may reduce speed and increase torque output from the die servo 700. For example, the die servo gearbox 710 may be configured to have a specific gear reduction (e.g., 10:1, 5:1, etc.). The die servo assembly 130 may not include the die servo gearbox 710. Alternatively, the die servo gearbox 710 may be integrated within the die servo 700.

In contrast to the seamer assembly 100, conventional seaming devices are plagued by several undesirable characteristics. For example, conventional seaming devices are not capable of accurately and reliably determining if a can assembly (e.g., the can assembly 420, etc.) has been sealed properly (e.g., with an effective double-seam, etc.). Currently, can assemblies are continuously visually inspected and measured or are processed through an expensive cross-section device. Because the cross-section device is expensive, current seaming device users typically utilize a mechanical instrument such as a caliper or micrometer to measure a thickness of the seam. However, using a mechanical instrument introduces a potential for operator error, and measurement is tedious and time consuming. Further, conventional seaming devices require routine can assembly "tear-downs" where a can assembly is torn apart to measure the seam. In addition to being time consuming and expensive, can assembly "tear-downs" require a specialized professional with unique skills to obtain accurate and reliable results. Accordingly, users of conventional seaming devices would benefit from using the seamer assembly 100 to ensure seam quality of can assemblies because the users benefit from decreased costs (e.g., monetary, temporal, etc.) related to the inspection and measurement of seams compared to the conventional seaming devices.

Additionally, components of conventional seaming devices are not easily replaced or upgraded. Conversely, the seamer assembly 100 is easily upgradable. For example, in one embodiment, the first die 730 and the second die 740 can be easily replaced and/or interchanged with different dies. Additionally, the seamer assembly 100 requires less manual recalibration compared to conventional seaming devices. In some applications, it is desirable to change (e.g., upgrade, etc.) the capabilities of the conventional seaming devices such as when changing over to a different a can style. Conventional seaming devices typically require extensive manual reconfiguration and recalibration, adding increased cost to this change. However, the seamer assembly 100 can be simply and efficiently reconfigured. For example, the chuck servo 500 and the die servo 700 can be altered to produce more torque or speed depending on the application. Further, the chuck servo 500 and/or the die servo 700 can be removed and replaced with a new chuck servo 500 and/or a new die servo 700 that is configured to produce more or different torque or speed.

The chuck servo assembly 120 and the die servo assembly 130 transform electrical energy (e.g., alternating current, direct current, etc.) into mechanical energy. According to various embodiments, the chuck servo assembly 120 is capable of controlling the open can 400 and the lid 410 when the open can 400 and the lid 410 are in contact with the chuck 520. For example, the chuck servo assembly 120 is capable of adjusting the speed of rotation of the open can 400 and the lid 410.

According to various embodiments, the die servo assembly 130 is configured to manipulate the position of the first die 730 and the second die 740 through the use of the die servo 700, the die servo gearbox 710, and/or the die seamer arm 720. Rather, a conventional seaming device typically utilizes a separate motor or air cylinder for controlling the speed of rotation for each tooling die. The die servo assembly 130 is capable of rotating the die seamer arm 720 a number of degrees in each direction such that the first die 730 and/or the second die 740 are provided with varying degrees of engagement with the open can 400 and the lid 410. Similar to the die servo assembly 130 is capable of adjusting and monitoring the position of the first die 730 and/or the second die 740. According to some embodiments, the first die 730 and/or the second die 740 are not provided rotational force from the die servo 700. Rather, according to various embodiments, the first die 730 and/or the second die 740 are translated relative to a position of the open can 400 and/or the lid 410.

In some applications, the chuck servo 500 is capable of slowing the rotation of the open can 400 and the lid 410 to a stop. For example, in one application, the chuck servo 500 acts as a brake to gradually slow down rotation of the open can 400 to a stop. Additionally or alternatively, the rotating platform 110 can be configured to slow the rotation of the open can 400 to a stop.

Figure 8:
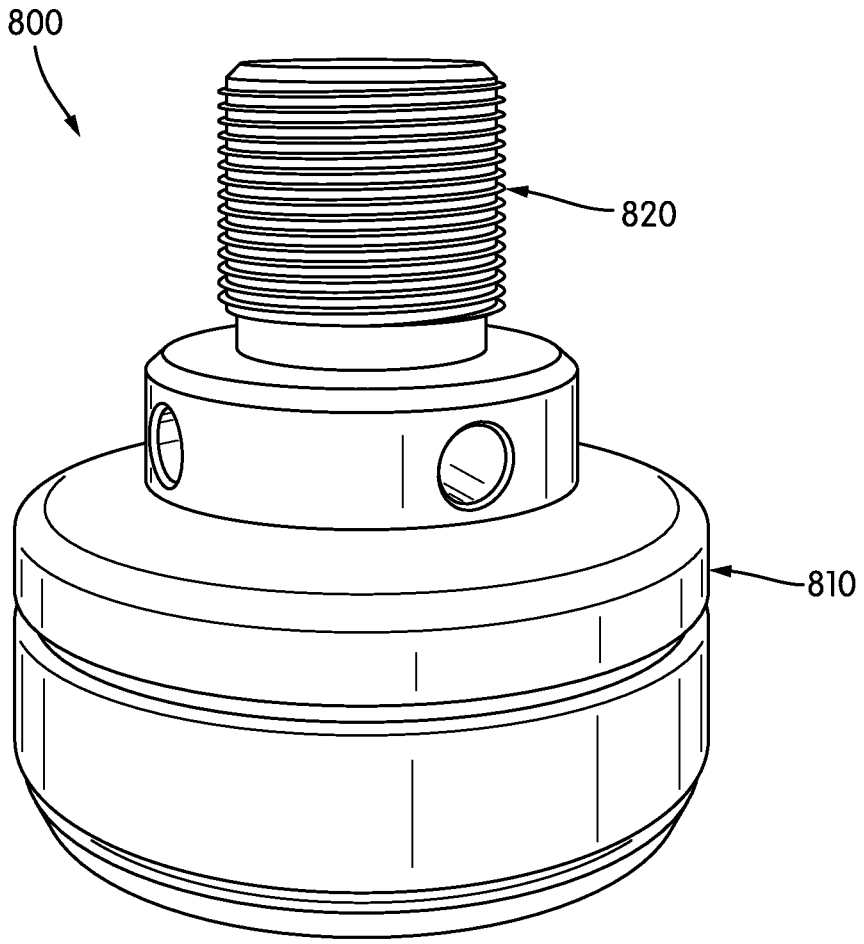
FIG. 8 is a front view of a die for use in the die servo assembly shown in FIG. 7, according to an exemplary embodiment.

As shown in FIG. 8, a die 800 (e.g., a tooling die, etc.) includes a gripping portion 810 integral to the die 800 and a threaded portion 820 also integral to the die 800. The die 800 is representative of the first die 730 and/or the second die 740. The gripping portion 810 can be used by an operator to manipulate (e.g., move, rotate, etc.) the die 800. The threaded portion 820 is used to attach the die 800 to another component of the seamer assembly 100 (e.g., the die seamer arm 720). The die 800 is representative of the first die 730 and/or the second die 740.

Figure 9:
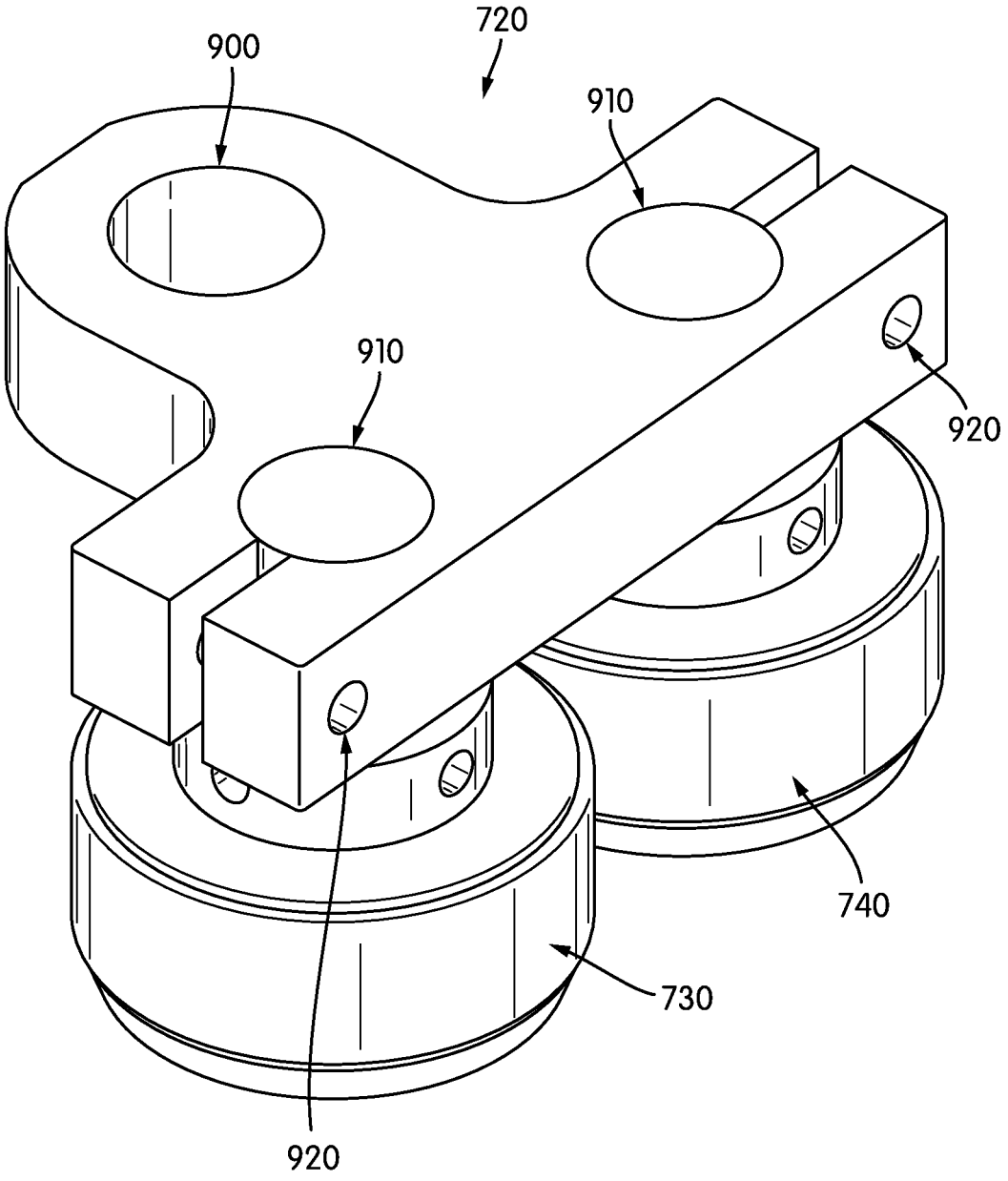
FIG. 9 is a perspective view of a die seamer arm for use in the die servo assembly shown in FIG. 7, according to an exemplary embodiment.

FIG. 9 illustrates the die seamer arm 720 in detail, according to an exemplary embodiment. The die seamer arm 720 is used to couple the first die 730 and the second die 740 to the seamer assembly 100. Further, the die seamer arm 720 transfers energy (e.g., rotation, torque, etc.) from the die servo 700 to the first die 730 and/or the second die 740. As shown in FIG. 9, the die seamer arm 720 includes a main opening 900, a pair of die openings 910, and a pair of fastener openings 920. According to an exemplary embodiment, the main opening 900 is capable of receiving a shaft from the die servo gearbox 710.

Although not shown in FIG. 9, the main opening 900 has a keyless bushing (e.g., a hub, etc.) such that the die seamer arm 720 can be coupled to the die servo gearbox 710 or the die servo 700 through the keyless bushing. In one embodiment, the main opening 900 receives a threaded shaft from the die servo 700 or the die servo gearbox 710 and the die seamer arm 720 is secured to the die servo 700 or the die servo gearbox 710 via a fastener (e.g., a nut, etc.). According to various embodiments, the fastener openings 920 receive threaded fasteners (e.g., screws, bolts, set screws, etc.) configured to secure the first die 730 and the second die 740 in the die seamer arm 720.

In some applications, the seamer assembly 100 includes two of the die seamer arms 720. Each of the die seamer arms 720 is coupled to one of the first die 730 and the second die 740. In this way, the two die seamer arms 720 may be operated independently (e.g., through the use of two separate servos, etc.) or through the use of the die servo 700 (e.g., through the use of a cam mechanism).

Figure 10:
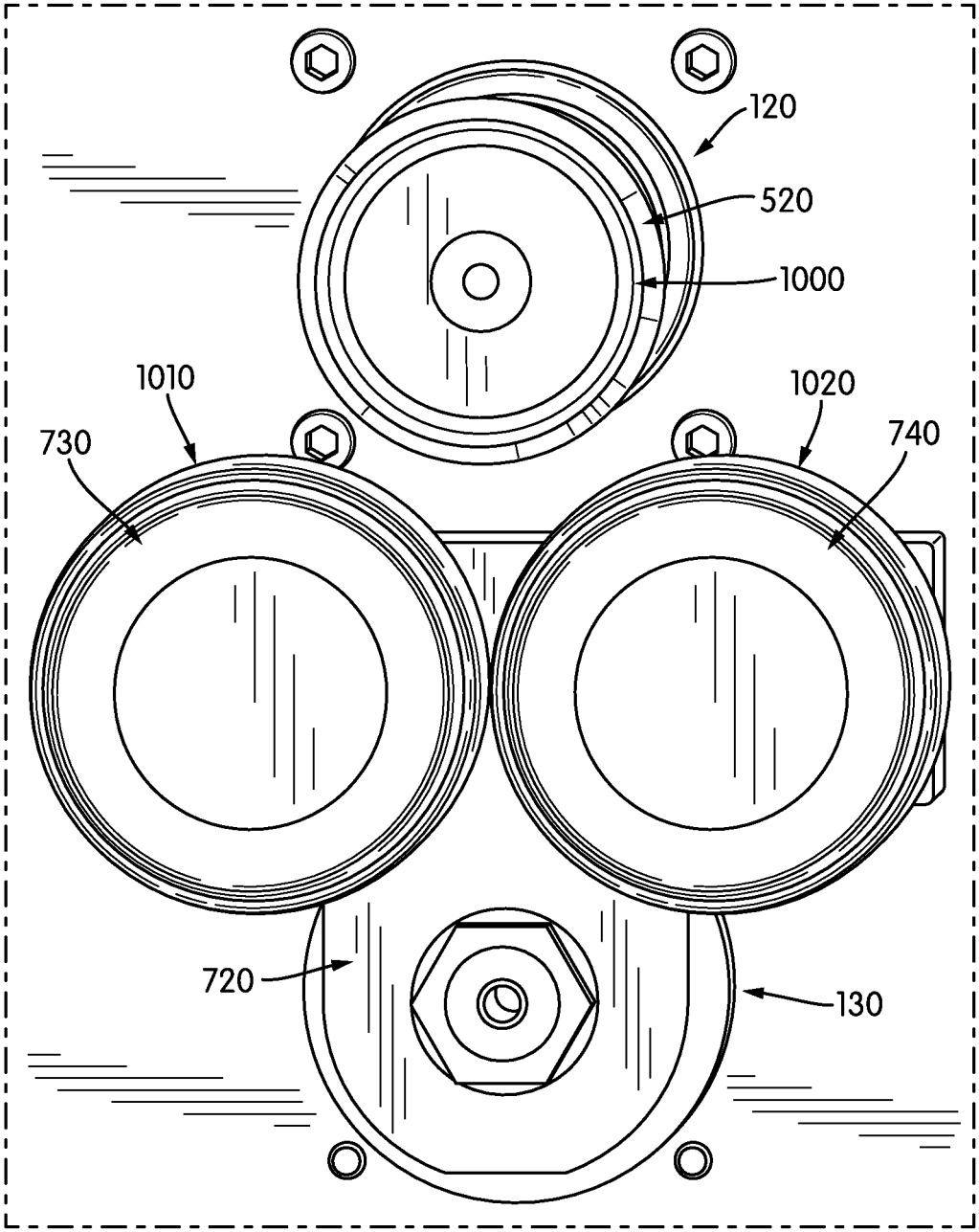
FIG. 10 is a bottom detailed view of a portion of the seamer assembly shown in FIG. 1, according to an exemplary embodiment.

FIG. 10 is a bottom detailed view of a portion of the seamer assembly, in particular, the chuck servo assembly 120 and the die servo assembly 130. The chuck servo assembly 120 and the die servo assembly 130 are installed in the seamer assembly 100. The seamer assembly 100 is operational when the chuck servo assembly 120 and the die servo assembly 130 are installed in the seamer assembly 100. According to various embodiments, the chuck 520 includes a chuck edge 1000 (e.g., an annular protrusion, a ridge, a rim, a ring, a rib, a lip, etc.) that is structurally integrated in the chuck 520. The chuck edge 1000 facilitates coupling of the chuck 520 to the lid 410 through an interaction (e.g., sliding fit, etc.) between an inner surface of the lid 410 and the chuck edge 1000.

In some embodiments, the first die 730 includes a first die edge 1010 (e.g., an annular recess, a gap, a ring, a void, etc.) that is structurally integrated in the first die 730, and the second die 740 includes a second die edge 1020 (e.g., an annular recess, a gap, a ring, a void, etc.) that is structurally integrated in the second die 740. The first die edge 1010 and the second die edge 1020 each correspond to a desired effect (e.g., shaping effect, tooling effect, edging effect, etc.) on the open can 400 and/or the lid 410. For example, the first die edge 1010 can be configured to fold the open can 400 onto the lid 410, or vice-versa (i.e., the lid 410 onto the open can 400), and the second die edge 1020 can be configured to flatten the open can 400 onto the lid 410. According to various embodiments, the chuck edge 1000, the first die edge 1010, and the second die edge 1020 cooperate to form a double-seam on the open can 400 and the lid 410 in the seamer assembly 100. In a preferred embodiment, the first die edge 1010 folds the open can 400 and the lid 410 together and the second die edge 1020 flattens the fold between the open can 400 and the lid 410.

Figure 11:
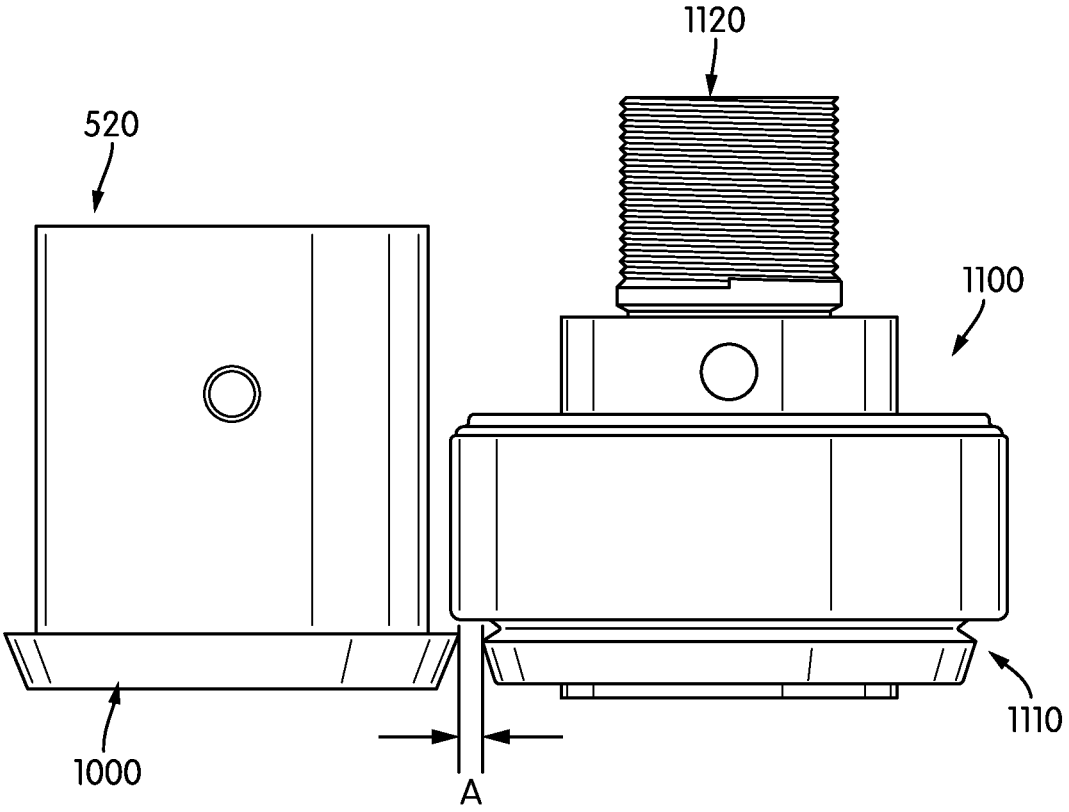
FIG. 11 is a side view of a chuck and a die for use in the seamer assembly shown in FIG. 1, according to an exemplary embodiment.

FIG. 11 shows the chuck 520 in proximity to a die 1100 (e.g., a tooling die, etc.). The die 1100 is be used to seal the lid 410 to the open can 400. The die 1100 is representative of the first die 730 and/or the second die 740. The die 1100 includes a die edge 1110 and a threaded portion 1120. The die edge 1110 is representative of the first die edge 1010 and/or the second die edge 1020. The chuck 520 and the die 1100 are separated by a distance (e.g., separation, gap, spacing, etc.), shown as dimension A which represents a distance between the die 1100 (e.g., the first die 730, the second die 740, etc.) and the chuck 520 at which the seaming process is to occur.

By utilizing the die servo assembly 130 to monitor current and/or torque required to seal the lid 410 to the open can 400, the seamer assembly 100 can utilize software to identify undesirable can assemblies 420 produced by the seamer assembly 100 in real time. Further, the chuck servo assembly 120 and the die servo assembly 130 can, in general, alert a user to any erratic and/or atypical behavior of the seamer assembly 100. If desired, the seamer assembly 100 can reject a can assembly 420 such that it is not passed through seamer assembly 100 (e.g., using the gate actuator 160 and the gate 170, etc.) in response to determining that a reject condition has occurred. For example, if the can subassembly 415 is raised by the rotating platform 110 and the chuck 520 is not received by the lid 410, a reject condition occurs and the seamer assembly 100 lowers the rotating platform 110 and rejects the can subassembly 415 (e.g., using the gate actuator 160 and the gate 170, etc.). In some applications, the seamer assembly 100 waits a period of time (e.g., one second, etc.), as determined by a timer, before lowering the rotating platform 110 and rejecting the can subassembly 415.

In an exemplary embodiment, the rotating platform 110 includes two sensors that monitor a position of the rotating platform relative to the lower panel 144. The sensors allow the seamer assembly 100 to determine if the rotating platform 110 is fully extended and/or fully retracted. During operation of the seamer assembly 100, the rotating platform 110 elevates a can subassembly 115 such that the lid 410 contacts the chuck 520. If the rotating platform 110 does not fully extend, as determined by the sensor, the can subassembly 115 may not contact the chuck 520 and a reject condition is detected by the seamer assembly 100. This reject condition may be detected when the can subassembly 115 is not centered on the rotating platform 110. When this reject condition is detected, the seamer assembly 100 lowers the can subassembly 115 and rejects the can subassembly 115 (e.g., using the gate actuator 160 and the gate 170, etc.).

Additionally or alternatively, the seamer assembly 100 can activate an alert such as an audible buzzer or a visual alert on a main screen of the seamer assembly 100. Still further, the seamer assembly 100 can temporarily halt any processes in a canning line (e.g., filling, seaming, packaging, dispensing, etc.) until the alert is addressed by the operator. The alert can indicate that a specific component of the seamer assembly 100 (e.g., the rotating platform 110, the chuck servo assembly 120, the die servo assembly 130, etc.) requires adjustment, servicing, and/or repair. In some applications, the chuck servo assembly 120 is, additionally or alternatively, utilized to monitor current and/or torque required to seal the lid 410 to the open can 400.

Figure 12:
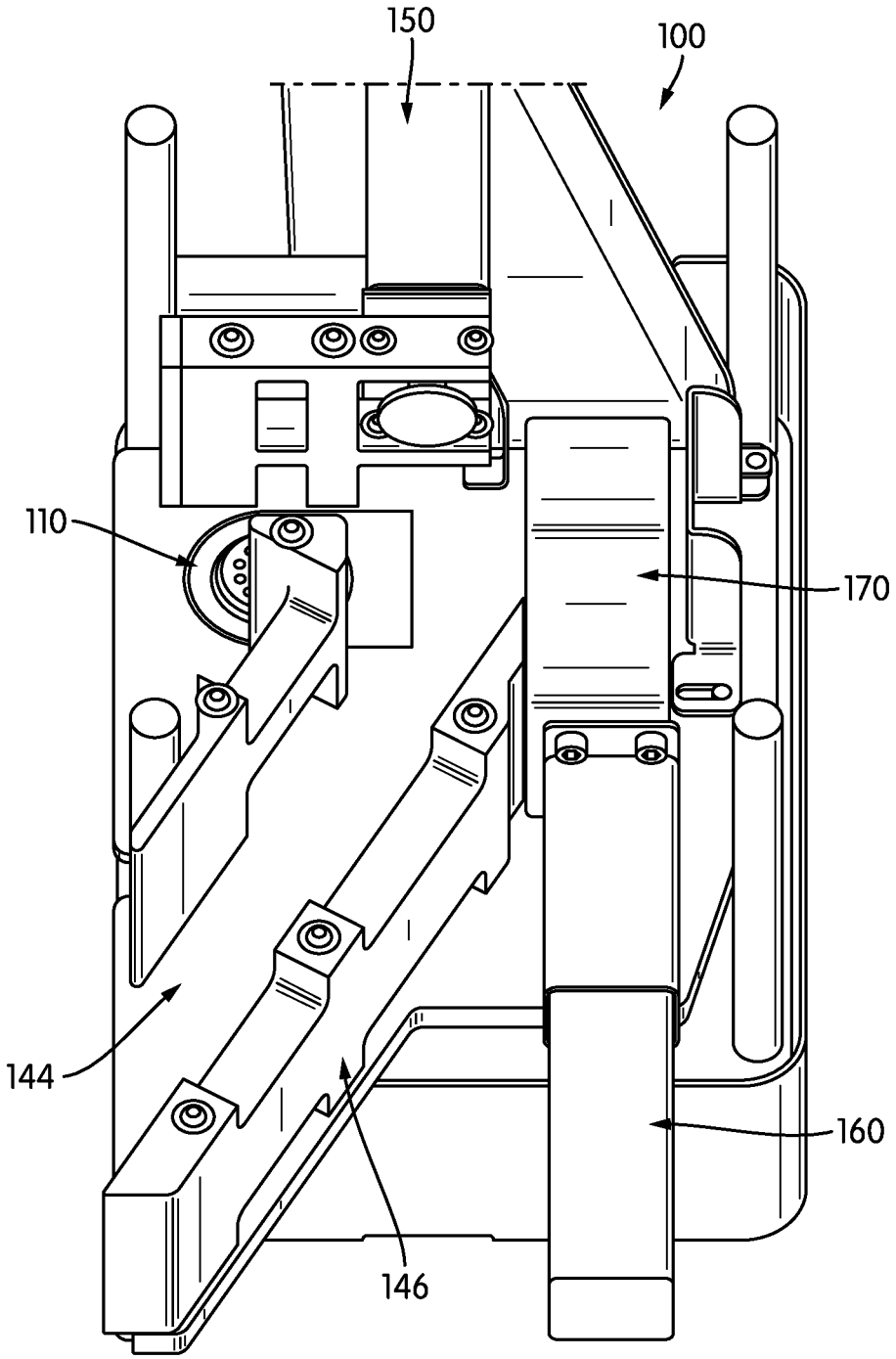
FIG. 12 is a top perspective view of the seamer assembly shown in FIG. 1 with various components hidden.
Figure 13:
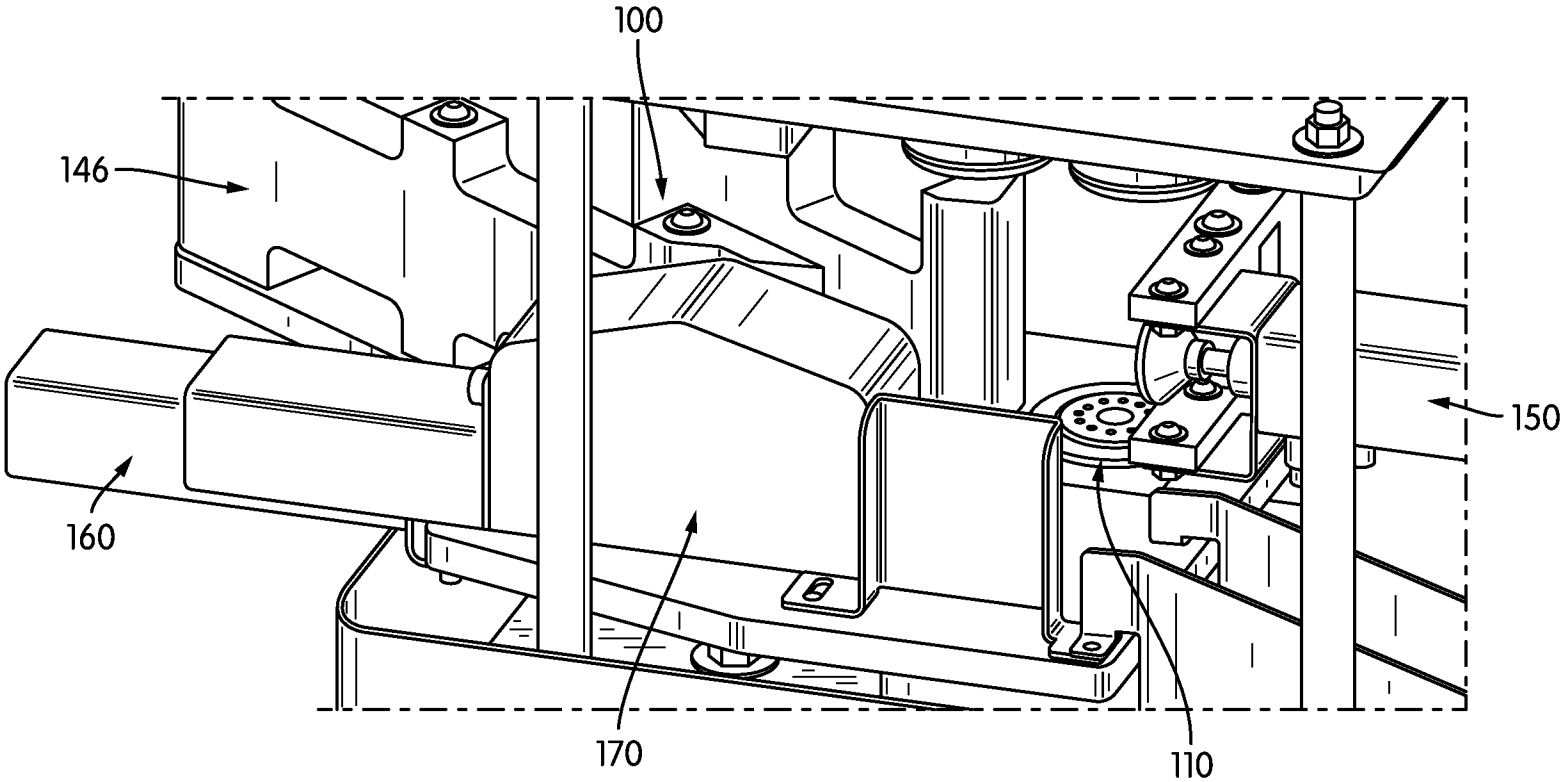
FIG. 13 is rear perspective view of the seamer assembly shown in FIG. 1.

FIGS. 12 and 13 provide additional views illustrating portions of the seamer assembly 100. Specifically, FIGS. 12 and 13 illustrate the configuration of the lower panel 144, the guide structure 146, the advancing actuator 150, the gate actuator 160, and the gate 170. The can advancing actuator 150 is structured to be capable of selectively ejecting the can assemblies 420 out of the seamer assembly 100. For example, after the chuck 520 is no longer received in the can assembly 420 (e.g., after the can assembly 420 has been double-seamed by the seamer assembly 100 and the rotating platform 110 is lowered), the can advancing actuator 150 can eject the can assembly 420 along the guide structure 146 out of the seamer assembly 100 and into a subsequent assembly line (e.g., a packaging line, a distribution line, etc.).

As previously mentioned, the seamer assembly 100 can have the ability to discern between the can assemblies 420 that are desirable and undesirable based on monitored data from the chuck servo assembly 120 and/or the die servo assembly 130. For example, the current consumed by the servo to create the can assembly can be compared against historical performance to ensure that the current consumed, falls within an acceptable range based upon historical performance of the dies in relation to the structure and can material. In this way, the seamer assembly 100 can determine if a can assembly 420 has received an adequate double-seam from the seamer assembly 100. In the event that a can assembly 420 has not received an adequate double-seam from the seamer assembly 100 (i.e., the can assembly 420 is undesirable), the can assembly 420 can utilize the gate actuator 160 and the gate 170 to separate the undesirable can assembly 420 into a separation region (e.g., a lane, a bin, a container, etc.). The gate 170 is selectively repositionable between an extended position whereby the gate 170 compliments the guide structure 146 and prohibits a can assembly 420 from entering the separation region unintentionally, and a retracted position whereby the gate 170 leaves an opening or void in the guide structure 146 that is sized to receive the can assembly 420. In operation, if the seamer assembly 100 determines that the can assembly 420 is undesirable, then the gate actuator 160 retracts the gate 170 and the undesirable can assembly 420 is pushed through the void left by the gate 170 in the guide structure 146 and into the separation region. However, if the seamer assembly 100 determines that the can assembly 420 is desirable, then the gate 170 remains in the extended position. Once in the separation region, a user can review the undesirable can assembly 420 manually. In other applications, the gate actuator 160 and the gate 170 can be used to sort two different types (twelve fluid ounces, sixteen fluid ounces, etc.), styles, and/or sizes of can assemblies 420.

Figure 14:
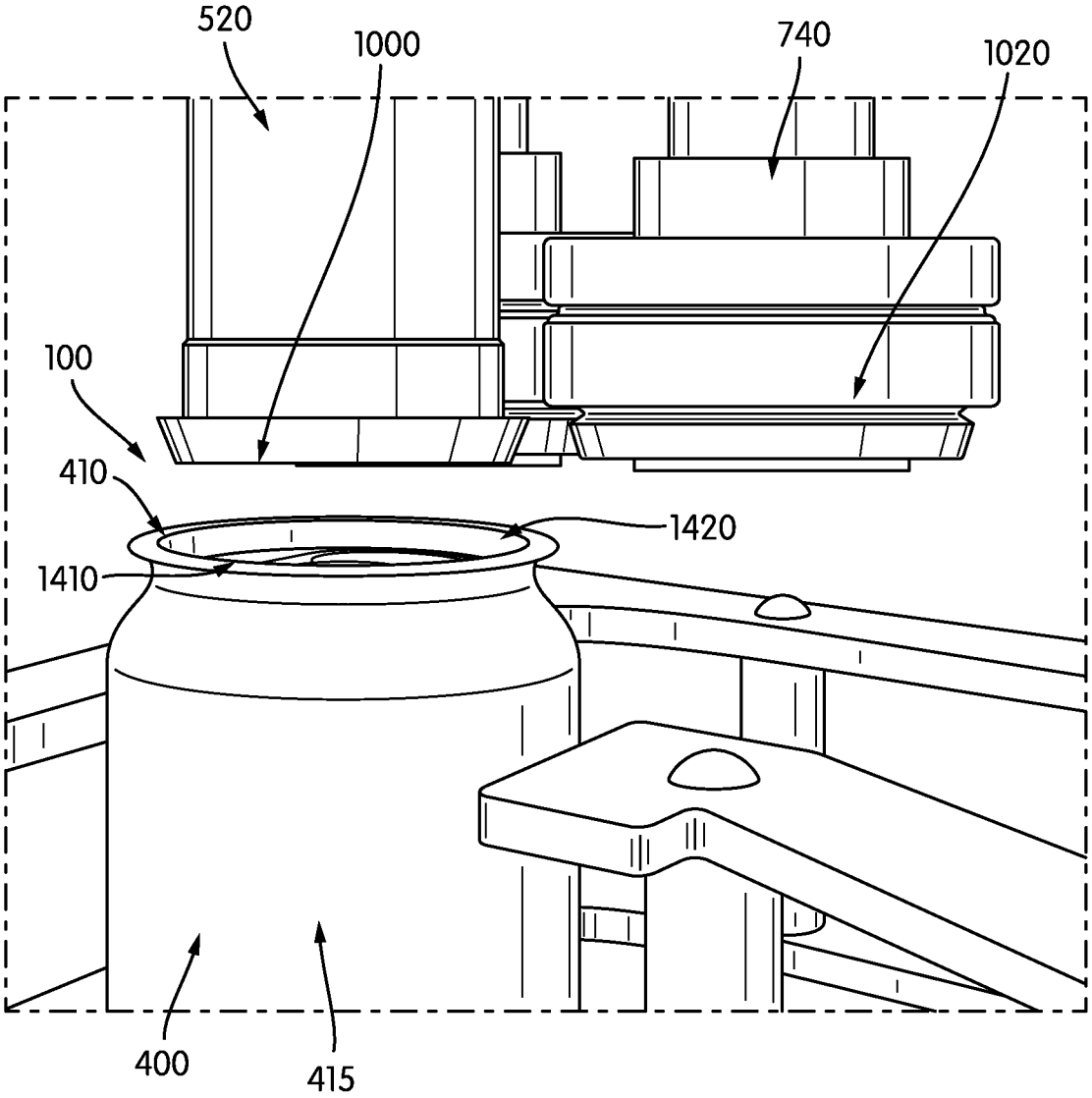
FIG. 14 is a front view of a first step in a seaming process using the seamer assembly shown in FIG. 1.
Figure 15:
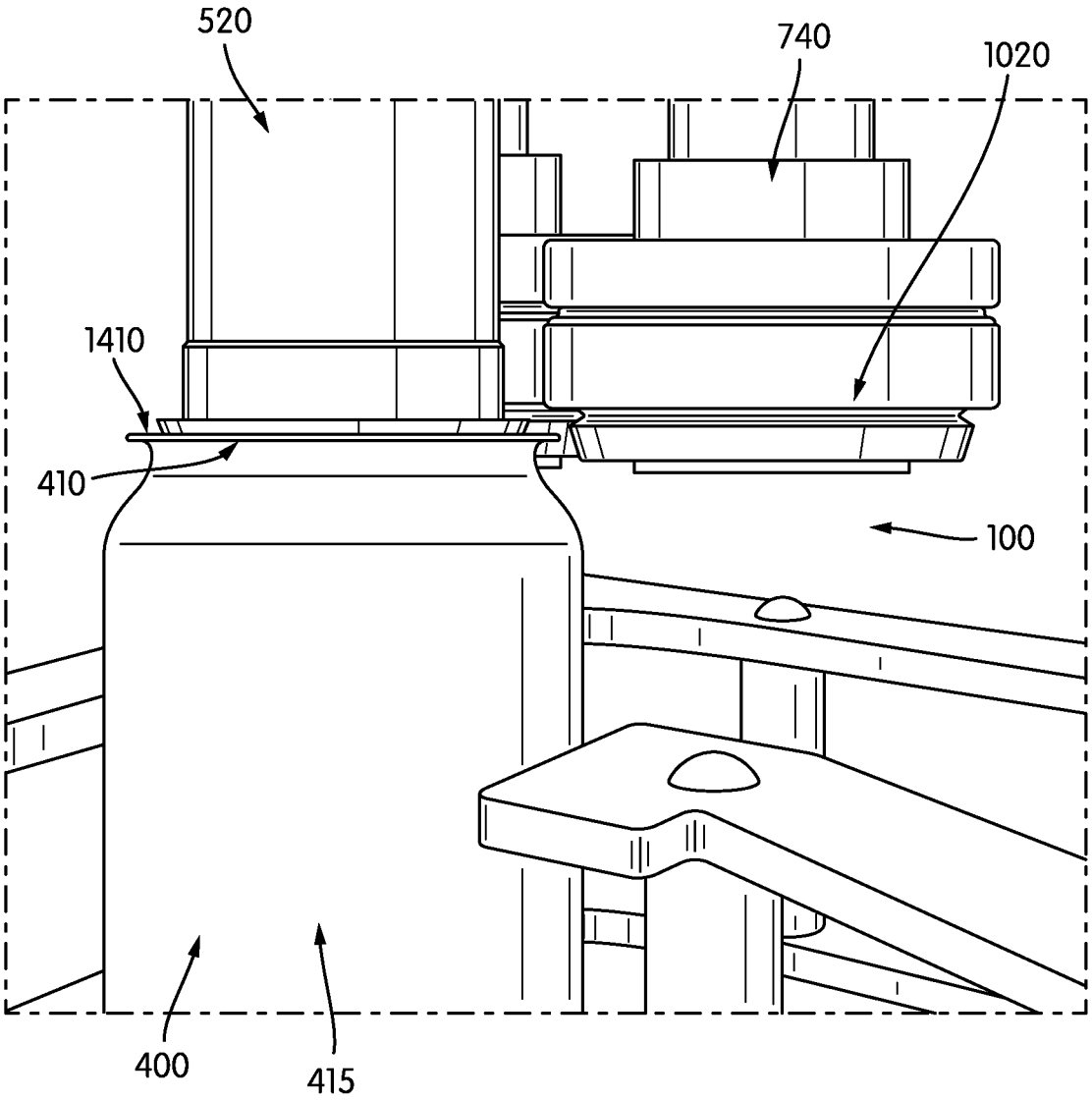
FIG. 15 is a front view of a second step in a seaming process using the seamer assembly shown in FIG. 1.

FIGS. 14-19 illustrate an exemplary seaming process using the seamer assembly 100. In essence, the seaming process occurs in a folding stage, accomplished by the first die 730, and a flattening stage, accomplished by the second die 740. As shown in FIG. 14, the seaming process begins with the seamer assembly 100 receiving the open can 400 and the lid 410. The open can 400 and the lid 410 include an edge 1410 that defines a central depression 1420 (e.g., an opening, an aperture, etc.). The edge 1410 may be a circular edge of the open can 400 and/or the lid 410 and the central depression 1420 may be a circular opening defining the open mouth of the open can 400 and/or the lid 410.

After receiving the open can 400 and the lid 410, the lid tamp 180 biases the lid 410 on the open can 400 using a ram (e.g., extension, rod, etc.). Next, the can subassembly 415 advances to the rotating platform 110. According to an exemplary embodiment, the rotating platform 110 receives the open can 400 and the lid 410 and elevates the open can 400 and the lid 410 such that the open can 400 and the lid 410 are coupled to or in contact with the chuck 520. At least one of the chuck servo assembly 120 and the rotating platform 110 provides a rotational force to the open can 400 and the lid 410. The chuck 520 is selected to be received within the central depression 1420.

In various embodiments, the lid tamp 180 is configured to determine if the lid 410 is located on the open can 400. For example, if an open can 400 advances into the seamer assembly 100 without a lid 410, the lid tamp 180 will detect that no lid 410 is present for the open can 400 and the seamer assembly 100 will detect a reject condition. The seamer assembly 100 then advances the open can 400 across upper panel 144 and rejects the can as a failure (e.g., using the gate actuator 160 and the gate 170, etc.).

As shown in FIG. 14, the chuck 520 is received within the central depression 1420 so that the chuck edge 1000 contacts the edge 1410. Similarly, when received in the central depression 1420, the chuck 520 and the rotating platform 110 preferably rotate at substantially the same speed. When the chuck 520 is received in the central depression 1420, the chuck servo assembly 120 and/or the die servo assembly 130 begin to measure data (e.g., current, voltage, torque, speed, number of rotations, etc.) associated with sealing the lid 410 to the open can 400. In some applications, the die servo assembly 130 monitors current consumed by die servo 700 to determine a torque imparted by the first die 730 and/or the second die 740 on the can subassembly 415 and/or the can assembly 420. The seamer assembly 100 determines when the first die 730 has contacted the can subassembly 415 for a target number of rotations of the can subassembly 415. Similarly, the seamer assembly 100 determines when the second die 740 has contacted the can subassembly 415 for a target number of rotations of the can subassembly 415. When the seamer assembly 100 has determined that both the first die 730 and the second die 740 have contacted the can subassembly 415 for the target numbers of rotations, the chuck servo assembly 120 and/or the die servo assembly 130 indicates to the seamer assembly 100 that the can subassembly 415 has been properly sealed. As described further below, a processor can be adapted to measure or sense the rotational energy of the chuck servo 500 and/or the open can 400 and the lid 410.

Figure 16:
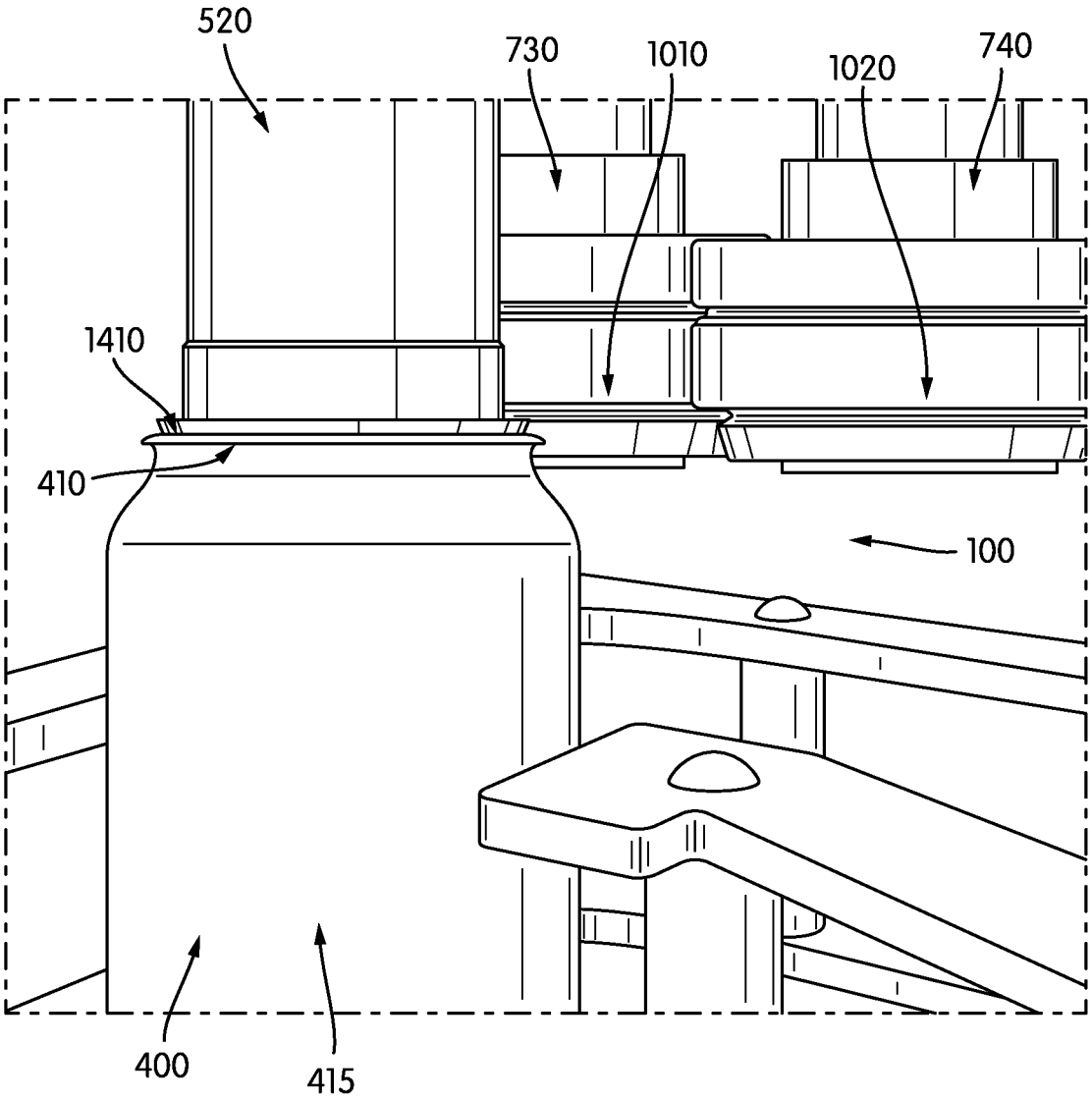
FIG. 16 is a front view of a third step in a seaming process using the seamer assembly shown in FIG. 1.

As shown in FIG. 16, the die servo assembly 130 brings the first die 730 into contact with the open can 400 and the lid 410. Specifically, according to one embodiment, the first die edge 1010 is placed in contact with the edge 1410 and exerts a radial force on the edge 1410. The combination of the force which the first die edge 1010 and the chuck edge 1000 exert on the edge 1410 results in the edge 1410 being folded over. The first die edge 1010 is substantially opposite the chuck edge 1000 when the first die edge 1010 is in contact with the edge 1410. Depending on the exact shape of the chuck edge 1000, the first die edge 1010, and the edge 1410, various shapes, sizes, and configurations of the edge 1410 are possible once the edge 1410 has been folded over. After a desired amount of folding of the edge 1410 has occurred (e.g., after the first period of time as determined by a timer, etc.), the die servo assembly 130 removes the first die 730 from being in contact with the open can 400 and the lid 410.

The desired amount of folding of the edge 1410 can be defined by a current and/or torque pattern, as measured by the die servo assembly 130, can be defined by a number of revolutions of the first die 730, or can be defined by a relative position and/or travel (e.g., a difference in positon compared to a starting location before the open can 400 and the lid 410 were coupled to the chuck 520, etc.) of the chuck 520, the first die 730, and/or the second die 740 relative to the edge 1410.

Figure 17:
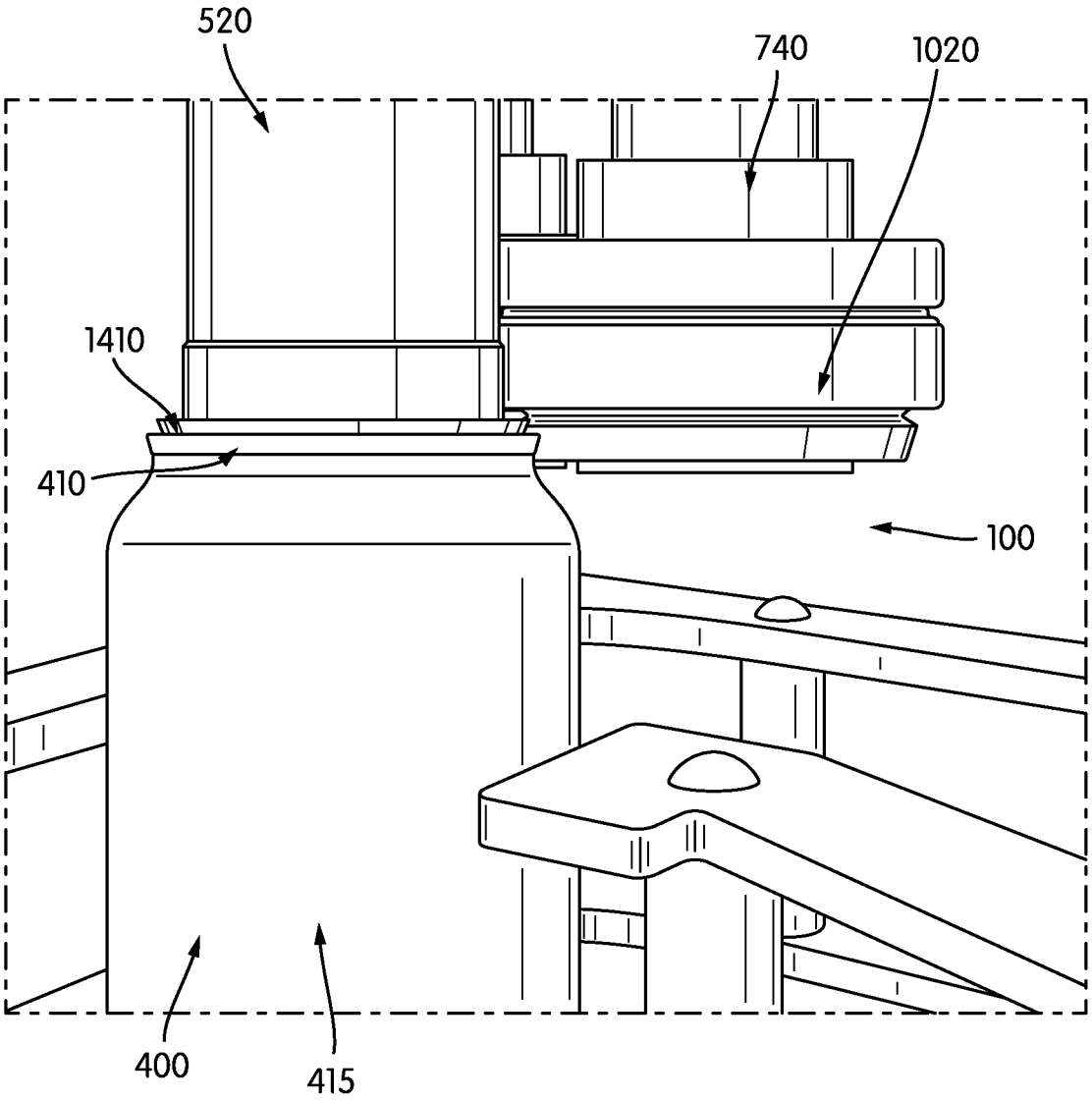
FIG. 17 is a front view of a fourth step in a seaming process using the seamer assembly shown in FIG. 1.

FIG. 17 illustrates the die servo assembly 130 bringing the second die 740 into contact with and exerting a force on the open can 400 and the lid 410 for a second operation. Specifically, according to one embodiment, the second die edge 1020 is placed in contact with the edge 1410. The combination of the force which the second die edge 1020 and the chuck edge 1000 exert on the edge 1410 results in the edge 1410 being flattened. The second die edge 1020 is substantially opposite the chuck edge 1000 when the second die edge 1020 is in contact with the edge 1410. Depending on the exact shape of the chuck edge 1000, the second die edge 1020, and the edge 1410, various shapes, sizes, and configurations of the edge 1410 are possible once the edge 1410 has been flattened. After a desired amount of flattening of the edge 1410 has occurred (e.g., after the second period of time as determined by a timer, etc.), the die servo assembly 130 removes the second die 740 from being in contact with the now-formed can assembly 420.

The desired amount of flattening of the edge 1410 can be defined by analyzing the current consumed by the chuck servo 500 and/or the die servo 700. This current can be related to a torque exerted on the can subassembly 415 and/or the can assembly 420. It is understood that the first die 730 and the second die 740 can be brought into contact with the open can 400 and the lid 410 such that a certain position or travel is achieved or such that a desired current and/or torque is obtained from the monitored data.

Figure 18:
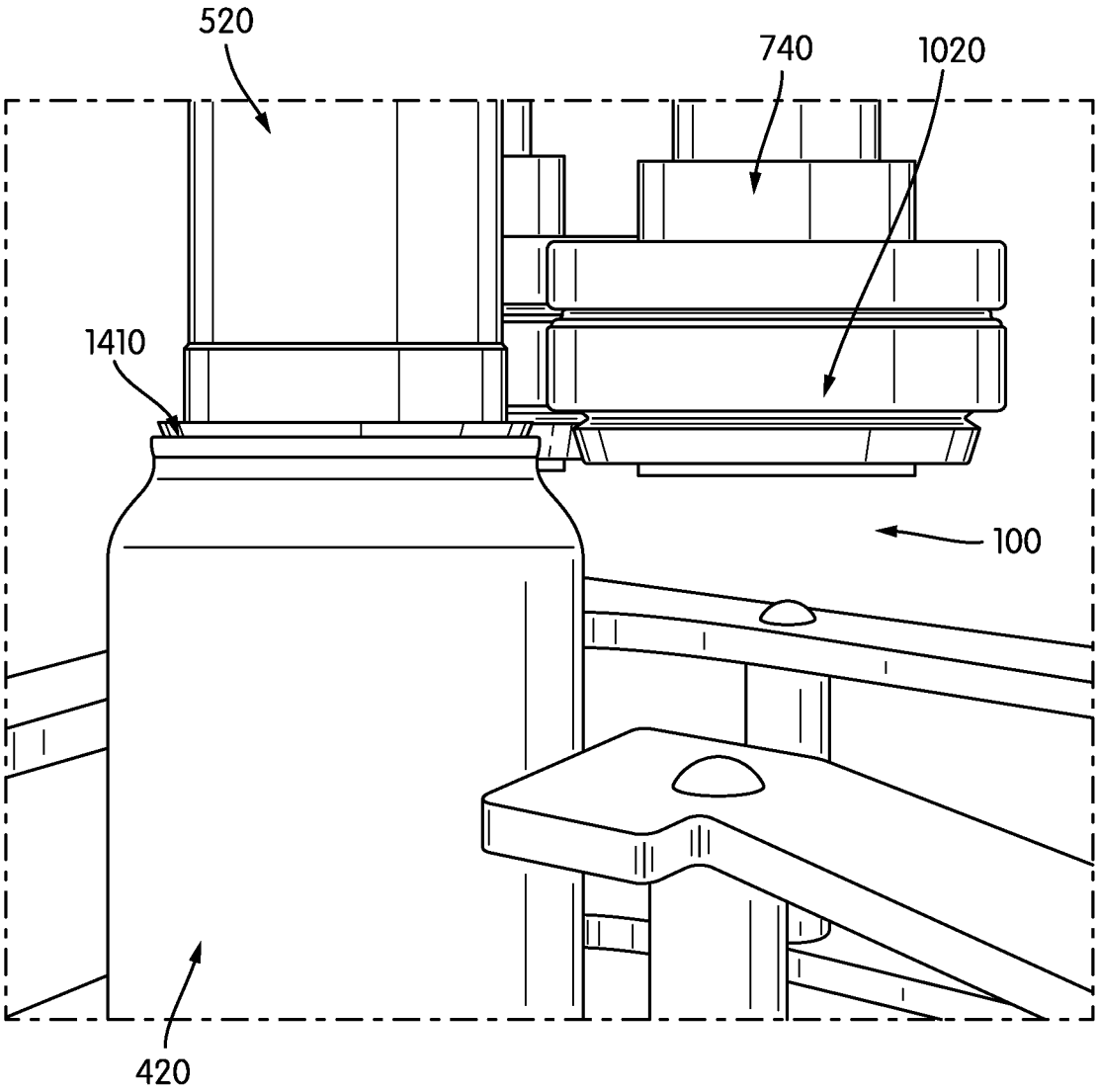
FIG. 18 is a front view of a fifth step in a seaming process using the seamer assembly shown in FIG. 1.
Figure 19:
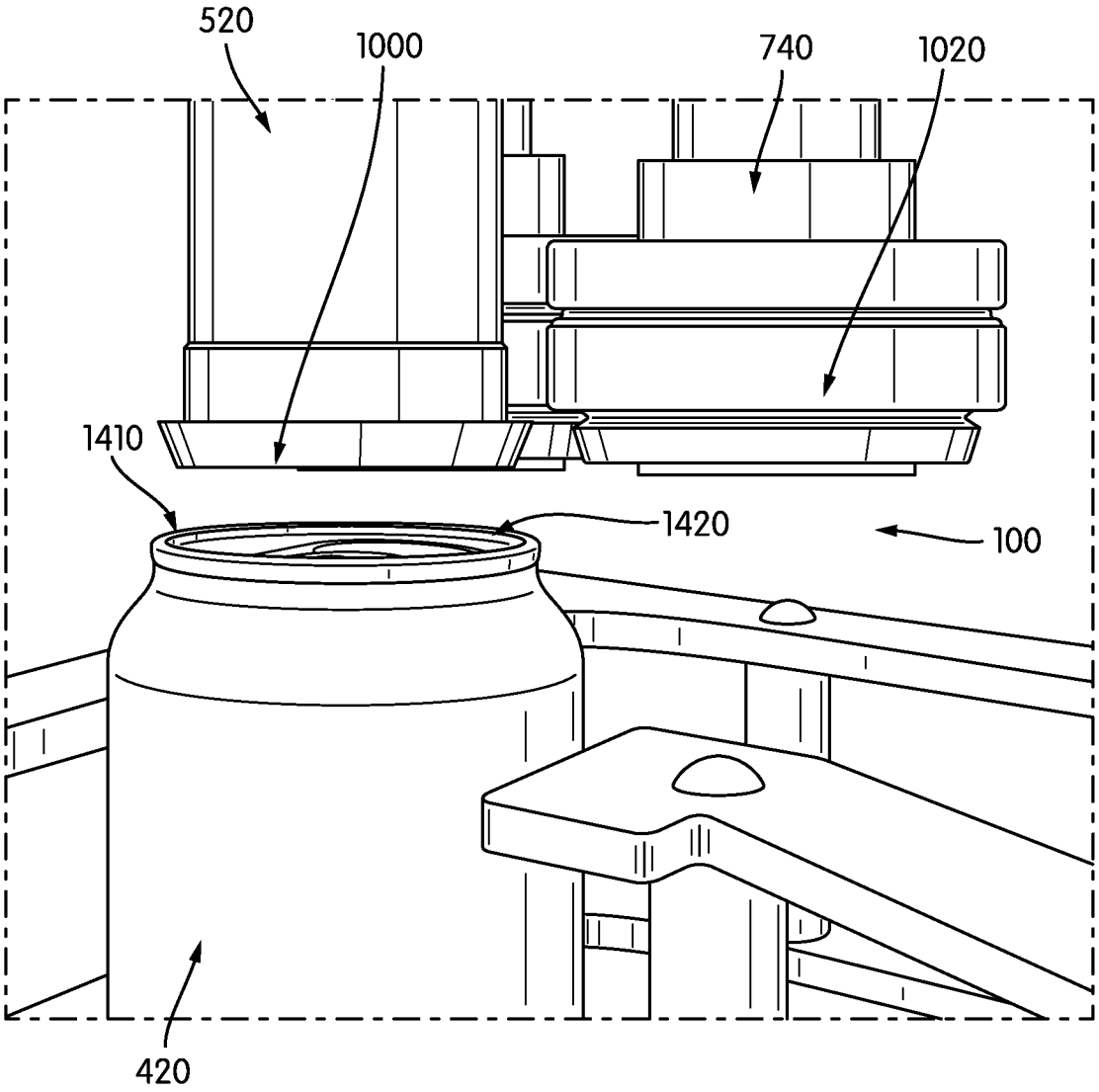
FIG. 19 is a front view of a sixth step in a seaming process using the seamer assembly shown in FIG. 1.

As shown in FIG. 18, once the second die 740 has been removed from contact with the can assembly 420, the can assembly 420 is free to rotate based upon force supplied by the chuck 520 and/or the rotating platform 110. As shown in FIG. 19, the rotating platform 110 is lowered, and the can assembly 420 is decoupled from (e.g., removed from contact with, etc.) the chuck 520. After the seaming process, the edge 1410 is a double-seam.

Depending on the configuration of the edge 1410, the chuck 520, the first die 730, and the second die 740, different shapes, sizes, and configurations of the edge 1410 are also possible. Similarly, while according to one process the steps of a seaming process are performed in one way, it is understood that the steps can also be performed in a similar way. For example, the first die 730 can be interchanged with the second die 740 while maintaining operation of the seamer assembly 100 such that the first die 730 can be brought into contact with the edge 1410 and then the second die 740 can be brought into contact with the edge 1410. Further, it is understood that the seaming process of the seamer assembly 100 can include more or less steps than described herein. Similarly, it is understood that any number of devices could perform the steps of the seamer assembly 100 in series or in parallel.

Figure 20:
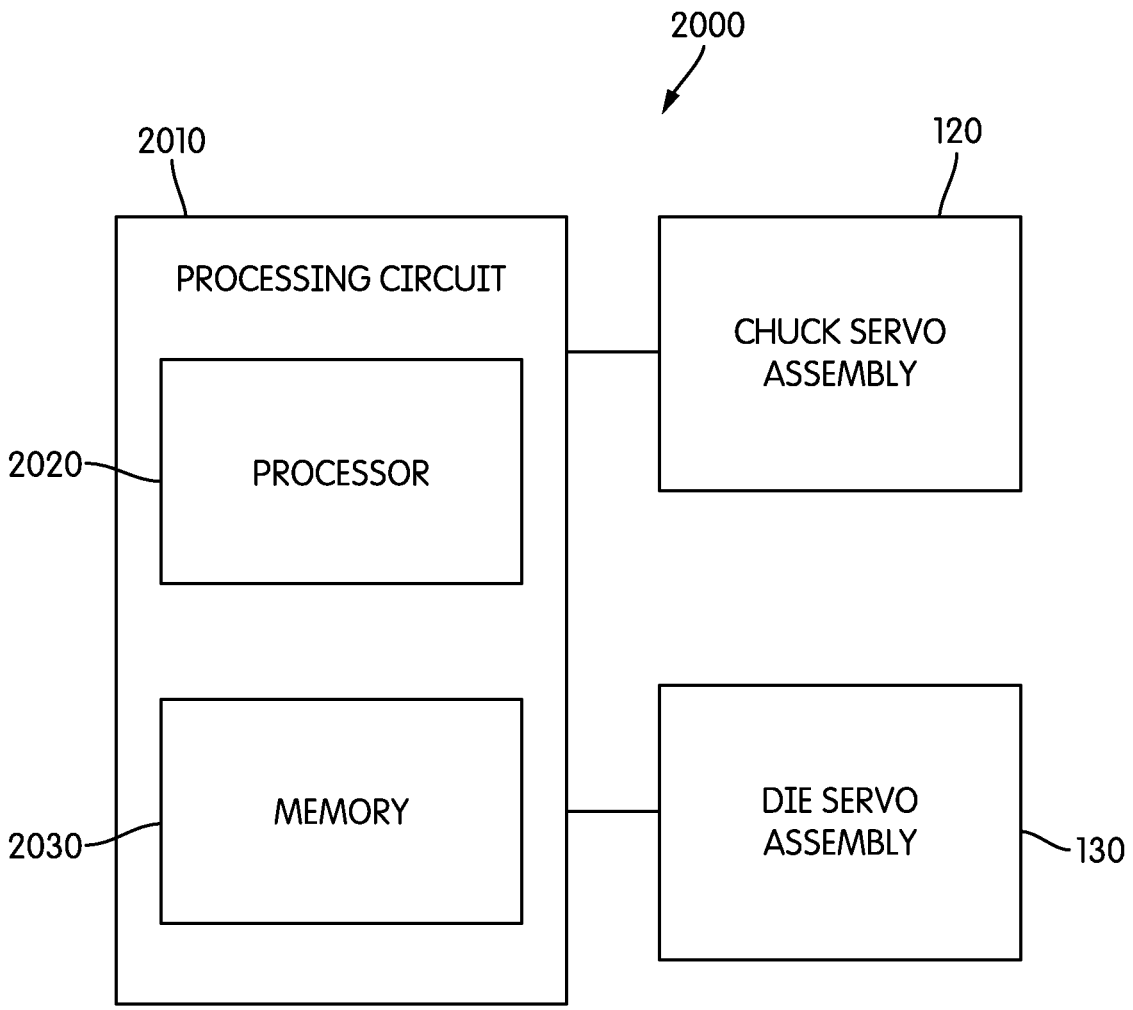
FIG. 20 is a control diagram for the seamer assembly shown in FIG. 1, according to an exemplary embodiment.
Figure 21:
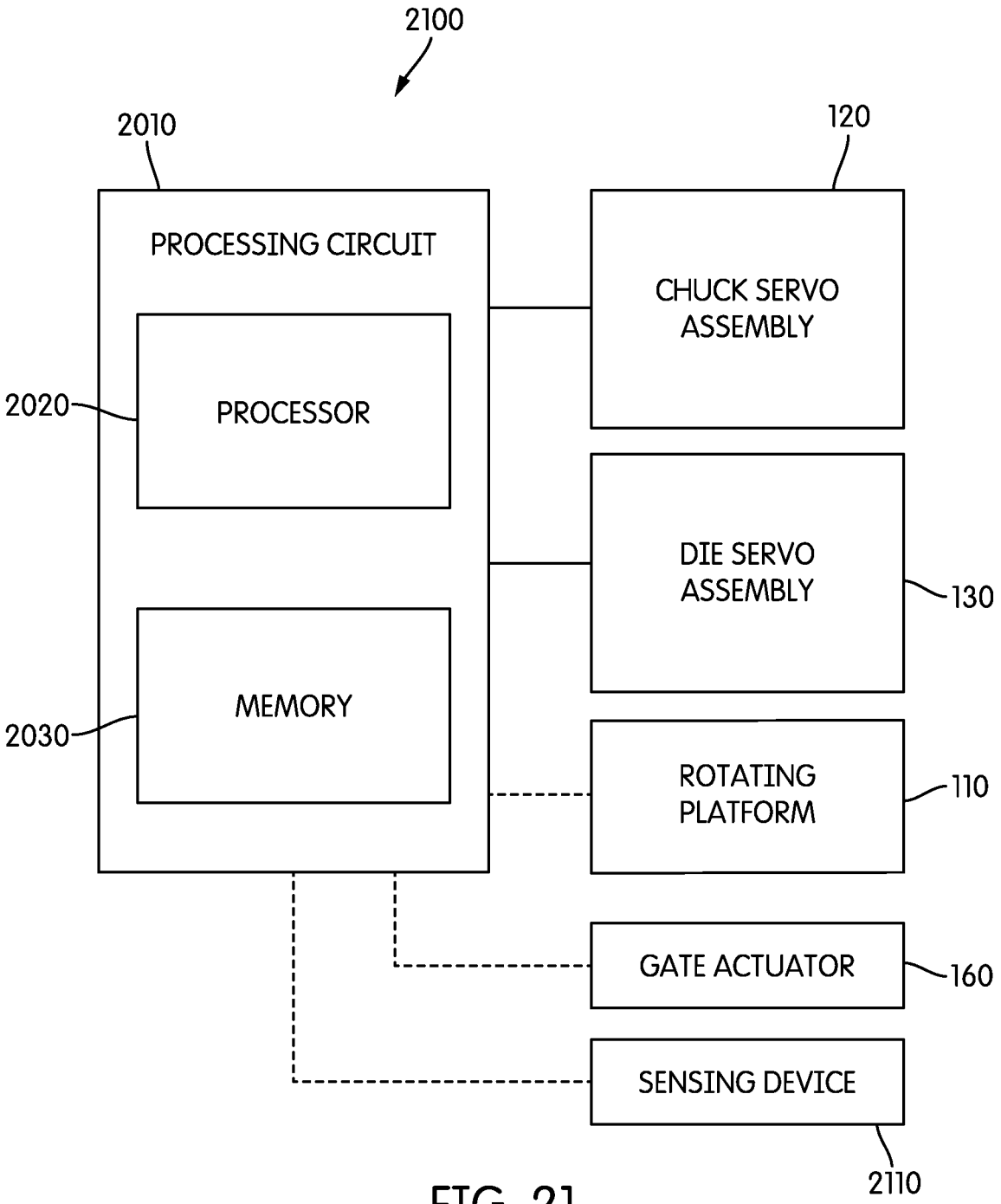
FIG. 21 is another control diagram for the seamer assembly shown in FIG. 1, according to an exemplary embodiment.

FIGS. 20 and 21 illustrate various control diagrams for the seamer assembly 100. As shown in FIG. 20, a control diagram 2000 includes a processing circuit 2010 (e.g., a circuit, etc.), a processor 2020, a memory unit 2030 within processing circuit 2010, the chuck servo assembly 120, and the die servo assembly 130. The processing circuit 2010 controls the seamer assembly 100, and the memory unit 2030 stores instructions for the processing circuit 2010 or monitored data from the seamer assembly 100. The chuck servo assembly 120 and the die servo assembly 130 are communicable with the processing circuit 2010.

The processing circuit 2010 can be contained within or can be external to the seamer assembly 100 and can manipulate the current consumed by the chuck servo assembly 120 and/or the die servo assembly 130 to obtain torque produced by the chuck servo assembly 120, the number of rotations of the can subassembly 415, and/or the die servo assembly 130, respectively. Therefore, by monitoring the current consumed, the processing circuit 2010 can similarly monitor the torque required to spin the can subassembly 415 to create the desired construction. Similarly, the processing circuit 2010 can monitor a position of the first die 730 and/or the second die 740.

In an exemplary embodiment, the chuck servo assembly 120 and/or the die servo assembly 130 transmit monitored data (e.g., position, current, torque, number of rotations, etc.) to the processing circuit 2010. By having access to monitored current and/or torque data for a can subassembly 415 and/or the position data of the chuck servo assembly 120 and/or the die servo assembly 130, the processing circuit 2010 is capable of comparing the monitored current, torque, and/or position to a desired pattern (e.g., consumption, etc.). For example, if the monitored current and/or torque deviates an undesirable amount (e.g., exceeds a threshold, etc.) from the desired pattern, the seamer assembly 100 can mark the can assembly for further inspection and/or detect a reject condition and thereby reject the can assembly 420 as a failure (e.g., using the gate actuator 160 and the gate 170, etc.). In an exemplary embodiment, the processing circuit 2010 is configured to compare monitored data from the chuck servo assembly 120 and/or the die servo assembly 130 to a pattern associated with a double-seam. Such a comparison by the processing circuit 2010 can prevent can assemblies 420 from being produced by the seamer assembly 100 that have been sealed improperly and/or inadequately (e.g., have an improperly sealed double-seam). Conventional seaming devices utilize motors and/or air cylinders to move the chuck and are unable to provide the accurate and the precise current and torque measurements provided by the die servo assembly 130.

The memory unit 2030 can store a library of different current and/or torque patterns corresponding to a number of different can edges, shapes, thicknesses, materials, and double-seam profiles. According to an exemplary operation, when a user wishes to switch the seamer assembly 100 from one can configuration to another, the user selects the new can configuration on a monitor of the seamer assembly 100. Once selected, the seamer assembly 100 loads the pattern for the new can configuration into the seamer assembly 100. Similarly, the library can also store information based on different combinations and configurations of the open can 400 and the lid 410.

In some embodiments, the processing circuit 2010 is configured to exhibit machine learning characteristics. For example, the seamer assembly 100 can include a "machine training mode." While in the machine training mode, the seamer assembly 100 can receive a single open can 400, and operate a seaming process on the open can 400, after which the seamer assembly 100 can provide a user with a user interface on a monitor. The user interface can include two buttons, for example one button labeled "Acceptable" and another button labeled "Unacceptable," and can be configured to receive and record user inputs, and deliver the user inputs to the processing circuit 2010. The user can interact with the user interface through an input device and/or an output device. The processing circuit 2010 can then adjust internal parameters (e.g., torque and/or speed of the chuck servo 500 and/or the die servo 700, distance of gap A in FIG. 11, etc.) according to the user inputs in order to produce only acceptable can assemblies 420.

Traditionally, a distance between dies in a conventional seamer device has been adjusted and/or maintained by a trained and specialized professional. The specialized professional would typically adjust an air cylinder or mechanical mechanism (e.g., cam, spring, set screw, etc.) by using a wrench or screwdriver. Such an adjustment process may be tedious and have a steep learning curve, therefore being undesirable. Conversely, the seamer assembly 100 can streamline, simplify, and even automate the adjustment process. For example, because the seamer assembly 100 utilizes the die servo assembly 130, which may provide monitored data to the processing circuit 2010 of the seamer assembly 100, the monitored data can be analyzed by an operator of the seamer assembly 100 or directly by the processing circuit 2010. Monitored data can be stored and archived, for example on a per-day, per-can (e.g., type, style, configuration, etc.), or per-hour basis. By analyzing monitored data, the user, or the processing circuit 2010, may be able to determine if a component needs servicing (e.g., to maintain dimension A, etc.) or if different electrical power should be supplied to and utilized by the chuck servo assembly 120 and/or the die servo assembly 130. Accordingly, the seamer assembly 100 is advantageous compared to a conventional seaming device because adjusting of the seamer assembly 100 is easier and faster than adjusting a conventional seaming device. For example, the size of gap A can be quickly and easily adjusted using a simple user interface. The size of the gap can be increased or decreased depending upon the resulting double seam. In some applications, the processing circuit 2010 of the seamer assembly 100 can utilize monitored data to determine if a variation in can configuration or type has occurred. For example, if the seamer assembly 100 is set up for a first can type (e.g., twelve fluid ounces) but receives cans that are a second can type (e.g., sixteen fluid ounces), the processing circuit 2010 can reconfigure the seamer assembly 100 for the second can type.

As shown in FIG. 21, a control diagram, shown as the control diagram 2100 includes the processing circuit 2010, the processor 2020, the memory unit 2030, the chuck servo assembly 120, the die servo assembly 130, the rotating platform 110, the gate actuator 160, and a sensing device 2110. According to various embodiments, the processing circuit 2010 is communicable with the chuck servo assembly 120, and the die servo assembly 130 and is optionally communicable with the rotating platform 110, the gate actuator 160, and the sensing device 2110. For example, processing circuit can be communicable with any of the rotating platform 110, the gate actuator 160, and the sensing device 2110 depending on the configuration of the seamer assembly 100. In one embodiment, the rotating platform 110 is configured to provide monitored data (e.g., rotational speed, torque, current, number of rotations, etc.) to the processing circuit 2010. Similarly, the processing circuit 2010 can control the rotating platform 110 (e.g., to cause rotating platform 110 to rotate, etc.). In an embodiment where the seamer assembly 100 is configured to utilize the gate actuator 160 to separate cans, the processing circuit 2010 is communicable with the gate actuator 160 (e.g., to extend the gate 170, to retract the gate 170).

According to an exemplary operation, the processing circuit 2010 is configured to cause the rotating platform 110 to elevate (e.g., raise, lift, etc.) the open can 400 and the lid 410 such that the chuck 520 is coupled with a depression 540 in the open can 400 and the lid 410 and the chuck edge 1000 is in confronting relation with the edge 1410. The processing circuit 2010 is further configured to cause the chuck servo 500 to rotate the chuck 520 and thereby rotate the open can 400 and the lid 410. The processing circuit 2010 is further configured to cause the die servo 700 to bring the first die 730 into contact with and exert a force on the open can 400 and the lid 410 for a first period of time (e.g., as determined by a timer, etc.), where the first die edge 1010 comes into contact with the open can 400 and the lid 410 at a location substantially opposite the chuck edge 1000. The processing circuit 2010 is further configured to remove the first die 730 from contact with the open can 400 and the lid 410. After the open can 400 and the lid 410 have been sufficiently deformed, the processing circuit 2010 is further configured to bring the second die 740 into contact with and exert a force on the open can 400 and the lid 410 for a second period of time (e.g., as determined by a timer, etc.), where the second die edge 1020 comes into contact with the open can 400 and the lid 410 at a location substantially opposite the chuck edge 1000. After the open can 400 and the lid 410 have been sufficiently deformed, the processing circuit 2010 is further configured to remove the second die 740 from contact with the open can 400 and the lid 410. The processing circuit 2010 is further configured to cause the rotating platform 110 to lower the open can 400 and the lid 410 such that the chuck 520 is decoupled from the central depression 1420.

In various embodiments, the seamer assembly 100 incorporates the sensing device 2110 to analyze cans to determine if a can is improperly sealed (e.g., "unacceptable"). The sensing device 2110 may be a camera, a sensor (e.g., image sensor, force sensor, pressure sensor, electrical sensor, capacitive sensor, leak detection sensor, etc.), or other sensing device configured to be used by the seamer assembly 100 to determine if the seamer assembly 100 has produced an acceptable or unacceptable can. As with the user inputs, the seamer assembly 100 can use information from the sensing device 2110 to adjust internal parameters to produce only acceptable cans. In particular, such a configuration of the seamer assembly 100 may be useful when a user is changing can type (e.g., from twelve fluid ounces to sixteen fluid ounces, etc.), lid type, and/or tooling (e.g., the chuck servo 500, the chuck 520, the die servo 700, the first die 730, the second die 740, etc.).

In some applications, the processing circuit 2010 incorporates a human-machine interface ("HMI") that provides information about the seamer assembly 100 to an operator. For example, the HMI may include a display that plots a torque provided by the first die 730 and/or the second die 740 in real time. The HMI may also display a rotational speed of the chuck 520, the can subassembly 415, and/or the can assembly 420.

Figure 22:
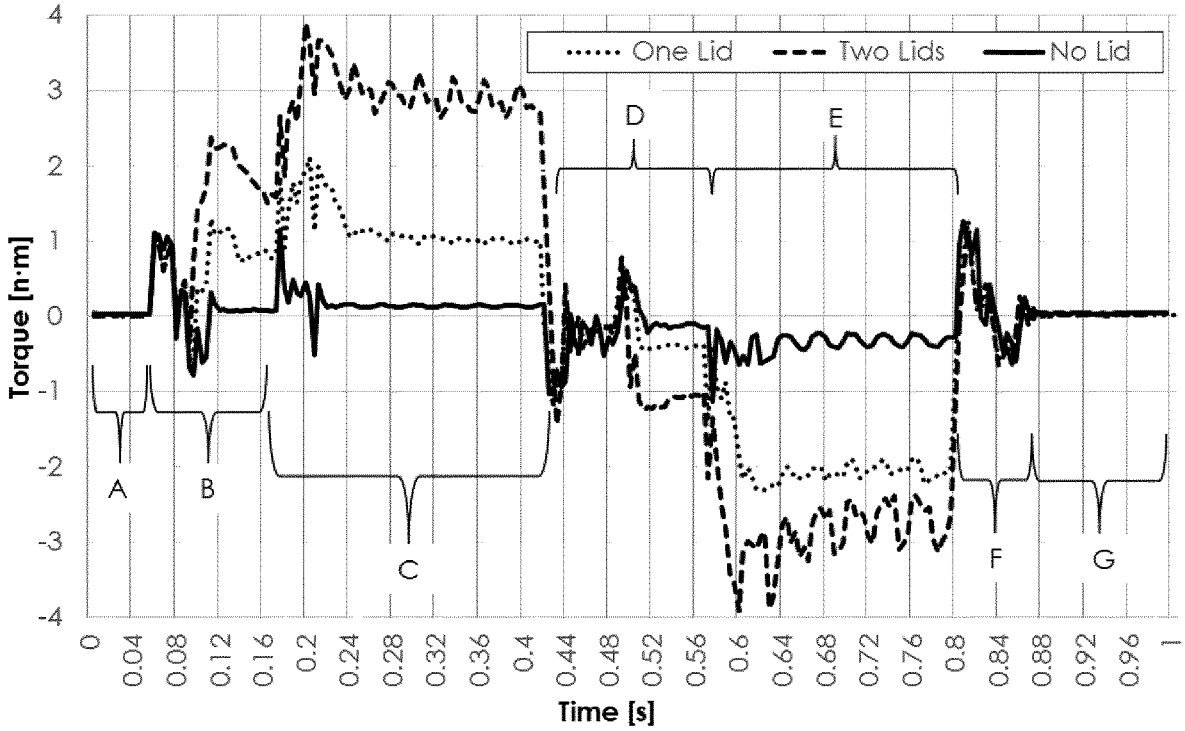
FIG. 22 is a plot of several torque ranges for a die servo assembly for the seamer assembly shown in FIG. 1, according to an exemplary embodiment.

As previously mentioned, the chuck servo assembly 120 and the die servo assembly 130 are capable of measuring an electrical current consumed by the chuck servo 500 and the die servo 700, respectively, to determine an amount of torque produced by the chuck servo 500 and the die servo 700, respectively. FIG. 22 illustrates the torque produced by the die servo 700 as a function of time on a first torque range, when the seamer assembly 100 seams one lid 410 to one open can 400, on a second torque range, when the seamer assembly 100 seams two lids 410 to one open can 400, and on a third torque range, when the seamer assembly 100 performs a seaming operation without a lid 410. As shown in FIG. 22, more torque is required to seam two of the lids 410 to the open can 400 than to seam one lid 410 to the open can 400.

Also shown on FIG. 22 are a number of steps, A-G, in the operation of the die servo assembly 130. In step A, the die seamer arm 720 begins at a home or resting position. While in the home or resting position, neither the first die 730 nor the second die 740 contact the can subassembly 415. For example, in step A, or before step A, the can subassembly 415 may be raised by rotating platform 110 such that the chuck 520 is received within the depression 540 in the lid 410. In step B, the die servo 700 causes the die seamer arm 720 to rotate, thereby bringing the first die 730 to a position that is proximate to can subassembly 415 while ensuring that the first die 730 does not contact the can subassembly 415. In this way, this initial rotation of the die seamer arm 720 may be performed quickly while preventing force from this rotation being transferred to the can subassembly 415 through the first die 730. In step C, the die servo 700 causes the die seamer arm 720 to rotate further, bringing the first die 730 into contact with the can subassembly 415. For example, one lid 410 may be partially double-seamed to an open can 400 by folding the open can 400 and the lid 410 together. The rotation of the first die 730 occurs more slowly in step C than in step B. In step D, the die servo 700 causes the die seamer arm 720 to rotate such that the first die 730 is rotated away from the can subassembly 415 and such that the second die 740 is simultaneously brought to a position that is proximate to can subassembly 415 while ensuring that the second die 740 does not contact the can subassembly 415. In this way, this rotation of the die seamer arm 720 may be performed quickly while preventing force from this rotation being transferred to the can subassembly 415 through the second die 740. The rotation of the first die 730 occurs more quickly in step D than in step C. In step E, the die servo 700 causes the die seamer arm 720 to rotate further, bringing the second die 740 into contact with the can subassembly 415. For example, this contact may flatten a fold between the open can 400 and the lid 410, thereby forming a complete double seam. The rotation of the second die 740 occurs more slowly in step E than in step D. In step F, the die seamer arm 720 rotates back to the home or resting position. In step G, the die seamer arm 720 is in the home or resting position and the die servo assembly 130 is ready to seam another can subassembly 415.

The torque produced by the die servo assembly 130 during steps A-G may be set by an operator in a computer program (e.g., stored in the memory unit 2030, etc.). In the computer program, the operator can select a torque range (e.g., from a database of suitable torque ranges for the seamer assembly 100 that is created by a manufacturer of the seamer assembly 100 and/or entered by an operator, etc.). For example, the operator may select a torque range corresponding to a double seam using one lid 410, a double seam using two lids 410, a double seam using one lid 410 on an eighteen fluid ounce can, and other similar applications.

In operation, the seamer assembly 100 actively compares the torque produced by the die servo assembly 130 to the selected torque range to determine if the can subassembly 415 is being seamed correctly. For example, the processing circuit 2010 may compare a torque produced by the die servo assembly 130 at a given time to a torque on the selected torque range at the given time. If this comparison is below a threshold, the processing circuit 2010 will determine that the can subassembly 415 is being properly seamed. Else, the processing circuit 2010 will determine that the can assembly 420 is being improperly seamed and detect a reject condition. When the reject condition is detected by the processing circuit 2010, the can subassembly 415 will be rejected by the seamer assembly 100 (e.g., using the gate actuator 160 and the gate 170, etc.). For example, if a reject condition is detected by the seamer assembly 100, the die servo assembly 130 may remove the first die 730 and/or the second die 740 from contact with the can subassembly 415, stop rotation of the can subassembly 415, lower the rotating platform 110, and reject the can subassembly 415. This threshold may be entered by the operator in the computer program. The threshold may be a percentage (e.g., a percent error, etc.) or a tolerance (e.g., plus or minus an amount of torque, etc.).

The seamer assembly 100 may also detect a reject condition if the seamer assembly detects that the torque produced by the die servo assembly 130 is within a non-selected torque range. For example, if the selected torque range is the "one-lid" torque range shown in FIG. 22, the seamer assembly 100 will detect a reject condition for can subassemblies 415 that do not include a lid 410, because the seamer assembly 100 determines that the torque produced by the die servo assembly 130 is following the "no lid" torque range shown in FIG. 22, and can assemblies 420 that include two lids 410, because the seamer assembly 100 determines that the torque produced by the die servo assembly 130 is following the "two lids" torque range shown in FIG. 22. For example, the seamer assembly 100 may prevent the operation of the die servo assembly 130 in the event that the lid 410 fell off the open can 400.

The computer program can also allow the operator to adjust the torque values for the torque produced by the die servo assembly 130. For example, the operator may manually examine the can subassembly 415 and/or the can assembly 420 to determine if the can subassembly was, or is being, properly seamed. The operator may examine a thickness of the seam, a width of the seam, a countersink depth, a cover hook length, an overlap length, and a pressure range condition, among other variables, when determining if the can assembly 420 has been properly seamed. For example, the operator may examine the can subassembly 415 to determine if thickness of the fold between the open can 400 and the lid 410, prior to contact between the second die 740 and the can subassembly 415 and after contact between the first die 730 and the can subassembly 415, is within a target range (e.g., plus or minus 0.002 inches, etc.). Through examination of the can subassembly 415 and/or the can assembly 420, the operator can utilize the computer program to construct a torque range that the die servo assembly 130 can utilize to repeatedly produce can assemblies 420 that have been properly seamed.

The computer program can also allow the operator to select the positions proximate to the can subassembly 415 that the die servo 500 brings the first die 730 and the second die 740 to. By selecting these positions, the operation of the seamer assembly 100 can be tailored for a target application. In other applications, step B is merged with step C, such that the die servo assembly 130 causes the first die 730 to be rotated from the home or resting position into contact with the can subassembly 415, without the slower approach provided by step B. Similarly, step D may be merged with step E such that the die servo assembly 130 causes the second die 740 to be rotated into contact with the can subassembly 415, without the slower approach provided by step D.

The computer program may, in some applications, also allow the operator to select the point in time in which steps A-G occur. For example, the operator may be able to specify a rotation (e.g., the fiftieth rotation, etc.) at which point step B begins, and a rotation (e.g., the one-hundredth rotation, etc.) at which point step B ends. Similarly, the point in time in which steps A-G occur may be dynamically (e.g., parametrically, etc.) be updated based on a number of rotations, entered by the operator in the computer program, required to seal the can subassembly 415. In some other applications, the computer program may also allow the operator to select the home or resting position (e.g., to keep the first die 730 and the second die 740 closer to the rotating platform 110 when the can subassembly 415 is relatively small, etc.).

It is understood that the seamer assembly 100 is capable of incorporating additional software and user interface features that would relay information from the seamer assembly 100 to a user. For example, the seamer assembly 100 may be configured to alert a user when the seamer assembly 100 is out of lids or cans. Similarly, the seamer assembly 100 may be configured to alert a user when a failure has occurred (e.g., blockage, etc.).

While the can 530, the open can 400, and the lid 410 have been shown as being metallic, it is understood that the seamer assembly 100 is similarly operable upon plastic, polymer, or composite cans. Similarly, the seamer assembly 100 is operable upon aluminum, stainless steel, tin, and other metallic cans. While the chuck 520, the first die 730, and the second die 740 have been shown to be metallic, it is understood that the seamer assembly 100 is similarly operable with plastic, polymer, ceramic, or composite versions of the chuck 520, the first die 730, and the second die 740. Similarly, the chuck 520, the first die 730, and the second die 740 may be brass, aluminum, stainless steel, titanium, or may be of other metallic construction and may be plated (e.g., zinc plated, etc.) or coated.

While the seamer assembly 100 has been shown and described to produce a double-seam, it is similarly understood that the seamer assembly 100 is capable of producing other seams and adjoining features as well. For example, by interchanging any one of the chuck 520, the first die 730, and the second 730, a new and/or additional seam may be produced. Similarly, it is understood that additional dies may be incorporated into the seamer assembly 100 such that other seams and/or adjoining features are possible. Additionally, while the seamer assembly 100 has been shown and described as operable on food and beverage cans, it is understood that the seamer assembly 100 may be operable on other types of canned goods such as paint cans, spray cans, aerosol cans, and other suitable canned goods.

In some embodiments, the chuck servo 500 and the die servo 700 are brushless servos. In some embodiments, the chuck servo 500 and the die servo 700 incorporate structurally limiting features that confine rotation and/or translation of the chuck 520, the first die 730, and/or the second die 740 to a particular range. These limiting features may protect various aspects of the seamer assembly 100 from inadvertent damage.

The embodiments described herein have been described with reference to drawings. The drawings illustrate certain details of specific embodiments that implement the systems, methods, and programs described herein. However, describing the embodiments with drawings should not be construed as imposing on the disclosure any limitations that may be present in the drawings.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary," as used herein to describe various embodiments, is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments and that such variations are intended to be encompassed by the present disclosure.

The present invention is not limited to the particular methodology, protocols, and expression of design elements, etc., described herein and as such may vary. The terminology used herein is for the purpose of describing particular embodiments only and is not intended to limit the scope of the present invention.

As used herein, the singular forms include the plural reference and vice versa unless the context clearly indicates otherwise. The term "or" is inclusive unless modified, for example by "either." For brevity and clarity, a particular quantity of an item may be described or shown while the actual quantity of the item may differ. Other than in the operating examples, or where otherwise indicated, all numbers and reference characters expressing measurements used herein should be understood as modified in all instances by the term "about," allowing for ranges accepted in the art.

Unless defined otherwise, all technical terms used herein have the same meaning as those commonly understood to one of ordinary skill in the art to which this invention pertains. Although any known methods, devices, and materials may be used in the practice or testing of the invention, the methods, devices, and materials in this regard are described herein.

It should be understood that no claim element herein is to be construed under the provisions of 35 U.S.C. § 112(f), unless the element is expressly recited using the phrase "means for."

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in deposit to explain the principals of the disclosure and its practical application to enable one skilled in the art to utilize the various embodiments and with various modifications as are suited to the particular use contemplated. Other substitutions, modifications, changes, and omissions may be made in the design, operating conditions, and arrangement of the embodiments without departing from the scope of the present disclosure.

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

The "circuit" may also include one or more processors communicatively coupled to one or more memory units or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

An exemplary system for implementing the overall system or portions of the embodiments might include a general purpose computing computers in the form of computers, including a processing unit, a system memory, and a system bus that couples various system components including the system memory to the processing unit. Each memory device may include non-transient volatile storage media, non-volatile storage media, non-transitory storage media (e.g., one or more volatile and/or non-volatile memories), etc. In some embodiments, the non-volatile media may take the form of ROM, flash memory (e.g., NAND, 3D NAND, NOR, 3D NOR, etc.), EEPROM, MRAM, magnetic storage, hard discs, optical discs, etc. In other embodiments, the volatile storage media may take the form of RAM, TRAM, ZRAM, etc. Combinations of the above are also included within the scope of machine-readable media. In this regard, machine-executable instructions comprise, for example, instructions and data which cause a general purpose computer, special purpose computer, or special purpose processing machines to perform a certain function or group of functions. Each respective memory device may be operable to maintain or otherwise store information relating to the operations performed by one or more associated circuits, including processor instructions and related data (e.g., database components, object code components, script components, etc.), in accordance with the example embodiments described herein.

It should also be noted that the term "input devices," as described herein, may include any type of input device including, but not limited to, a keyboard, a keypad, a mouse, joystick, or other input devices performing a similar function. Comparatively, the term "output device," as described herein, may include any type of output device including, but not limited to, a computer monitor, printer, facsimile machine, or other output devices performing a similar function.

What is claimed is:

1. A seamer assembly adapted for seaming a can subassembly formed from a can body and a lid, the seamer assembly comprising:

a frame;

a first servo assembly coupled to the frame, the first servo assembly comprising a chuck that is configured to be rotated by the first servo assembly;

a second servo assembly coupled to the frame;

a first support element coupled to the frame and configured to support a can subassembly relative to the frame wherein at least one of the first support element, the first servo assembly, and second servo assembly move relative to the other of the first support element, the first servo assembly, and second servo assembly;

a first die configured to be rotated by the second servo assembly in a first direction towards the chuck;

a second die configured to be rotated by the second servo assembly in a second direction towards the chuck;

a processing circuit configured to measure a current consumed by the second servo assembly to determine a torque supplied by the first die or the second die to a can subassembly and to compare the torque to a predefined torque range;

a first actuator coupled to the frame, the first actuator operable between a first actuator first state and a first actuator second state; and a gate coupled to the frame and repositionable relative to the frame, the gate moveable between a first gate position and a second gate position;

wherein the first support element is configured to support a can subassembly such that the chuck is adapted to be selectively received in a first chuck position;

wherein the first servo assembly is configured to selectively rotate a can subassembly when the chuck is received in the first chuck position;

wherein the first actuator is configured to transition the gate between the first gate position and the second gate position by moving the first actuator from the first actuator first state to the first actuator second state;

wherein first die and the second die are configured to cooperate to form a can assembly by selectively contacting a can subassembly;

wherein the gate facilitates a first path for one of a can assembly and a can subassembly to traverse towards an assembly line in the first gate position; and wherein the gate facilitates a second path for one of a can assembly and a can subassembly to traverse towards a separation region distinct from the assembly line in the second gate position.

2. The seamer assembly of claim 1, wherein the processing circuit is configured to move the first actuator from the first actuator first state to the first actuator second state in response to determining that the torque is not within the predefined torque range.

3. The seamer assembly of claim 1, wherein contact between the first die and a can subassembly or contact between the second die and a can subassembly causes a lid to be seamed to a can body thereby, forming a can assembly; and wherein the first support element is configured to lower the can assembly such that the chuck is decoupled therefrom.

4. The seamer assembly of claim 3, further comprising a second actuator coupled to the frame, the second actuator moveable between a second actuator first state and a second actuator second state;

wherein the second actuator is configured to move from the second actuator first state to the second actuator second state in response to determining that the first support element has been lowered.

5. The seamer assembly of claim 3, wherein contact between the first die and a can subassembly partially causes a lid to be seamed to a can body; and wherein contact between the second die and a can subassembly occurs after contact between the first die and a can subassembly and causes a lid to be seamed to a can body thereby forming a can assembly.

6. The seamer assembly of claim 5, wherein the first die is defined by a first die edge configured to contact a can subassembly; and wherein the second die is defined by a second die edge configured to contact a can subassembly.

7. The seamer assembly of claim 1, further comprising:

a second support element coupled to the first die and configured to be rotated by the second servo assembly in the first direction towards the chuck; and a third support element coupled to the second die and configured to be rotated by the second servo assembly in the second direction towards the chuck.

8. The seamer assembly of claim 7, wherein rotation of the second support element is independent of rotation of the third support element; and wherein rotation of the third support element is independent of rotation of the second support element.

9. The seamer assembly of claim 7, further comprising a cam mechanism coupled to the second servo assembly and configured to interface with the second support element to rotate the first die in the first direction towards the chuck and to interface with the third support element to rotate the second die in the second direction towards the chuck.

10. A seamer assembly adapted for sealing a can subassembly formed from a can body and a lid, the seamer assembly comprising:

a frame;

a first servo assembly coupled to the frame, the first servo assembly comprising a chuck that is configured to be rotated by the first servo assembly;

a second servo assembly coupled to the frame;

a first support element configured to support a can subassembly relative to the frame;

a first die configured to be rotated by the second servo assembly relative to the first support element and in a first direction towards the chuck;

a second die configured to be rotated by the second servo assembly relative to the first support element and in a second direction towards the chuck;

a second support element coupled to the first die and configured to be rotated by the second servo assembly relative to the first support element and in the first direction towards the chuck;

a third support element coupled to the second die and configured to be rotated by the second servo assembly relative to the first support element and in the second direction towards the chuck;

a processing circuit configured to measure a current consumed by the second servo assembly to determine a torque supplied by the first die or the second die to a can subassembly and to compare the torque to a predefined torque range;

a first actuator coupled to the frame, the first actuator operable between a first actuator first state and a first actuator second state; and a gate coupled to the frame and repositionable relative to the frame, the gate operable between a first gate position and a second gate position;

wherein the first servo assembly is configured to selectively rotate a can subassembly relative to first support element;

wherein the first actuator is configured to transition the gate between the first gate position and the second gate position by moving the first actuator from the first actuator first state to the first actuator second state;

wherein first die and the second die are configured to cooperate to form a can assembly by selectively contacting a can subassembly;

wherein the gate facilitates a first path for one of a can assembly and a can subassembly to traverse towards an assembly line in the first gate position; and wherein the gate facilitates a second path for one of a can assembly and a can subassembly to traverse towards a separation region separate from the assembly line in the second gate position.

11. The seamer assembly of claim 10, wherein the processing circuit is configured to move the first actuator from the first actuator first state to the first actuator second state in response to determining that the torque is not within the predefined torque range.

12. The seamer assembly of claim 10, wherein the first die is defined by a first die edge configured to contact a can subassembly; and wherein the second die is defined by a second die edge configured to contact a can subassembly.

13. The seamer assembly of claim 10, wherein rotation of the second support element is independent of rotation of the third support element; and wherein rotation of the third support element is independent of rotation of the second support element.

14. The seamer assembly of claim 10, further comprising a cam mechanism coupled to the second servo assembly and configured to interface with the second support element to rotate the first die in the first direction towards the chuck and to interface with the third support element to rotate the second die in the second direction towards the chuck.

15. A seamer assembly adapted for sealing a can subassembly formed from a can body and a lid, the seamer assembly comprising:

a first servo assembly configured to selectively provide a first rotational force;

a chuck coupled to the first servo assembly and configured to be selectively received in a first chuck position relative to a can subassembly thereby causing a can subassembly to be coupled to the chuck, the chuck further configured to receive the first rotational force from the first servo assembly and to provide the first rotational force to a can subassembly when the chuck is in the first chuck position a second servo assembly configured to selectively provide a second rotational force;

a first die configured to be rotated by the second servo assembly in a first direction towards the chuck and to receive the second rotational force;

a second die configured to be rotated by the second servo assembly in a second direction towards the chuck and to receive the second rotational force;

a first support element configured to facilitate rotation of the first die in the first direction towards the chuck;

a second support element configured to facilitate rotation of the second die in the second direction towards the chuck;

a cam mechanism coupled to the second servo assembly and configured to cooperate with the first support element to rotate the first die in the first direction towards the chuck and to cooperate with the second support element to rotate the second die in the second direction towards the chuck; and a processing circuit configured to:

control the second rotational force such that one of the first die and the second die selectively contacts a can subassembly for a first period of time and such that the other of the first die and the second die selectively contacts a can subassembly for a second period of time thereby forming a can assembly;

receive an input from a user corresponding to a target can assembly; and vary, based on the input, at least one of:

(i) a distance between the first die and the chuck when the first die contacts the can subassembly; and (ii) a distance between the second die and the chuck when the second die contacts the can subassembly;

wherein the second servo assembly is configured to selectively rotate a can subassembly.

* * * * *